US011540652B1

(12) United States Patent
Summerfield

(10) Patent No.: US 11,540,652 B1
(45) Date of Patent: Jan. 3, 2023

(54) ERECTABLE SHELF DISPLAY

(71) Applicant: Abbott-Action, Inc., Attleboro, MA (US)

(72) Inventor: Andrew C. Summerfield, Quincy, MA (US)

(73) Assignee: Abbott-Action, Inc., Attleboro, MA (US)

( * ) Notice: Subject to any disclaimer, the term of this patent is extended or adjusted under 35 U.S.C. 154(b) by 0 days.

(21) Appl. No.: 17/554,846

(22) Filed: Dec. 17, 2021

(51) Int. Cl.
*A47F 5/11* (2006.01)
*A47F 5/00* (2006.01)

(52) U.S. Cl.
CPC ..... *A47F 5/116* (2013.01); *A47F 5/114* (2013.01); *A47F 2005/0075* (2013.01)

(58) Field of Classification Search
CPC .. A47F 5/116; A47F 5/11; A47F 5/112; A47F 5/008; A47F 5/114; A47F 2005/0075; A47B 47/06; A47B 43/02; A47B 55/06; B65D 5/5028; B65D 5/503; B65D 5/36; B65D 5/3607
USPC ..... 211/135, 72, 149, 126.16; 108/165; 248/174
See application file for complete search history.

(56) References Cited

U.S. PATENT DOCUMENTS 1,926,793 A * 9/1933 Richards ..... A47F 5/116 108/115
2,150,743 A * 3/1939 Mancuso ..... A47F 5/116 229/108.1
2,597,731 A * 5/1952 Hoy ..... A47F 5/112 211/73
2,713,984 A * 7/1955 Paige ..... A47F 5/114 D6/683
2,889,127 A * 6/1959 Rossi ..... A47F 5/112 211/73
2,918,178 A * 12/1959 Leone ..... A47F 5/116 211/195
3,004,744 A * 10/1961 Wall ..... A47F 5/112 248/174
4,311,100 A * 1/1982 Gardner ..... A47F 5/116 108/165
4,618,115 A * 10/1986 Belokin, Jr. ..... A47F 5/116 248/174

(Continued)

*Primary Examiner* — Jennifer E. Novosad
(74) *Attorney, Agent, or Firm* — Morse, Barnes-Brown & Pendleton, P.C.; Sean D. Detweiler, Esq.

(57) ABSTRACT

A method and apparatus for an erectable shelf display can transition between a collapsed flattened configuration and a deployed standing display configuration simply and quickly without the need for tools, fasteners, adhesives, or complicated instruction. The erectable shelf display makes use of a foldable frame and folding shelves that work in conjunction to allow the erectable shelf to have a collapsed flattened configuration for storage and transportation and a deployed standing display configuration wherein the foldable frame maintains and locks the deployed configuration of the shelves into place, while the deployed configuration of the shelves maintains and locks the foldable frame in the deployed standing display configuration. This allows the erectable shelf display to be formed of lighter, less durable, and/or disposable materials typically used for temporary displays but still support weight comparative to a permanent display and have durability more comparable to a permanent display.

36 Claims, 16 Drawing Sheets

(56) References Cited

U.S. PATENT DOCUMENTS 4,630,740 A * 12/1986 Belokin, Jr. ..... A47B 87/0253 248/174
4,854,246 A * 8/1989 Belokin ..... A47F 5/116 108/162
5,183,166 A * 2/1993 Belokin, Jr. ..... A47F 5/116 211/130.1
5,209,391 A * 5/1993 Krautsack ..... B65D 5/0218 229/110
5,273,169 A * 12/1993 Maglione ..... A47F 5/116 108/162
5,315,936 A * 5/1994 Smith ..... A47F 5/116 108/165
5,465,851 A * 11/1995 Smith ..... A47F 5/11 108/162
5,706,959 A * 1/1998 Smith ..... A47F 5/0018 108/165
5,826,732 A * 10/1998 Ragsdale ..... A47F 5/116 108/165
5,984,120 A * 11/1999 Johnske ..... A47F 5/116 211/132.1
6,098,820 A * 8/2000 Smith ..... A47F 5/116 211/132.1
6,752,280 B2 * 6/2004 Dye ..... A47F 5/116 108/162
6,848,371 B2 * 2/2005 Zheng ..... A47B 43/02 108/165
7,007,615 B2 * 3/2006 Grueneberg ..... A47F 5/116 108/165
7,882,966 B2 * 2/2011 Field ..... A47F 5/116 211/72
8,286,809 B2 * 10/2012 Mestres Armengol ..... A47F 5/116 211/73
10,159,361 B2 * 12/2018 Jolley ..... A47F 5/114
10,448,757 B2 * 10/2019 Urban ..... A47F 5/116
10,470,591 B1 * 11/2019 Heiden ..... A47F 5/116
10,524,588 B2 * 1/2020 Pratsch ..... A47B 43/02
10,531,750 B1 * 1/2020 Heiden ..... A47F 5/0018
10,842,297 B2 * 11/2020 Meuti ..... A47F 5/116
2002/0043554 A1 * 4/2002 White ..... A47F 5/112 229/242
2003/0062327 A1 * 4/2003 Pickett ..... A47B 43/02 211/72
2005/0022703 A1 * 2/2005 Wintermute, II ..... A47F 3/063 108/165
2012/0305512 A1 * 12/2012 L'Hotel ..... A47F 5/116 211/198
2015/0114920 A1 * 4/2015 Kula ..... A47F 5/116 211/186
2017/0238727 A1 * 8/2017 Ertl ..... G09F 1/065
2018/0289178 A1 * 10/2018 McMillan-Sweat .... A47F 5/116
2018/0325287 A1 * 11/2018 López Fernández ... A47F 5/116
2019/0090663 A1 * 3/2019 Donegan ..... A47F 5/112
2020/0375375 A1 * 12/2020 Robinson ..... A47B 55/06
2021/0015273 A1 * 1/2021 Nelson ..... A47F 5/114

* cited by examiner

ERECTABLE SHELF DISPLAY

FIELD OF THE INVENTION

The present invention relates to shelf displays suitable for displaying goods. In particular, the present invention relates to an erectable shelf display that can easily transition between a flattened collapsed configuration and a deployed standing configuration.

BACKGROUND

Generally, shelf displays are either designed to be permanent or temporary. Permanent shelf displays typically are made of durable materials (wood, metal, plastic). Permanent displays typically contain many separate parts (frames, panels, shelves, fasteners, etc.) that need to be assembled and attached together to form the display. Once assembled, permanent displays are typically difficult to move or disassemble. Such permanent displays are typically made in such a manner that assembly and disassembly require tools, complicated assembly instructions, and a significant amount of time and space.

Temporary displays are typically made of lighter, less durable, and/or disposable materials (cardboard, paper stock, thin plastic). As such, temporary displays typically are easier to position or move into a desired location and can be easily disassembled or broken down after use. However, the use of lighter, less durable, and/or disposable materials also can limit the amount of weight the display can carry without collapsing. Temporary displays typically also contain many separate parts (frames, panels, shelves, etc.) that are provided in an unassembled state that need to be assembled and attached together to form the display. While such temporary displays typically do not require tools for assembly, the displays typically still involve complicated assembly instructions, and require a significant amount of time and space to assemble or disassemble. Furthermore, the end result of an assembled temporary display is often unsteady, not particularly durable, and can fall apart with minor movement or jostling by customers or staff. As such, a significant number of temporary displays end up being ineffective, especially when they are not set up properly.

SUMMARY

There is a need for an erectable shelf display that can be provided, shipped, or stored in a collapsed state but be deployed quickly and simply without the need for tools, complicated instructions, and then remain assembled in a durable state. The present invention is directed toward further solutions to address this need, in addition to having other desirable characteristics. Specifically, the erectable shelf display of the present invention can be provided in a pre-assembled collapsed configuration that can be transitioned to the deployed standing shelf display configuration quickly and easily without the need for tools or complicated instruction. In addition, the reinforced shelf design of the present invention allows the shelves of the display to bear weight similar to a permanent shelf despite being formed of lighter, less durable, and/or disposable materials. Typically, displays of this type take 5 to 10 minutes to put together. The display of the present invention assembles in 30 seconds or less. The display of the present invention was tested at 400 lbs. per shelf before failing. The display of the present invention can safely hold up to 100 lbs. per shelf, which is the maximum weight of similar displays in the marketplace.

In accordance with example embodiments of the present invention, an erectable shelf display is provided. The erectable display includes a foldable frame, a first folding shelf, and a second folding shelf.

The foldable frame includes a left-side panel, a front panel in pivotable connection with the left-side panel, a right-side panel in pivotable connection with the front panel, and a back panel in pivotable connection with the right-side panel and the left-side panel. The front panel further includes a first opening disposed in the front panel and a second opening disposed in the front panel. The foldable frame transitions from a collapsed flattened configuration to a deployed standing display configuration by unfolding the foldable frame at the pivotable connections between the left-side panel, the front panel, the right-side panel, and the back panel.

The first folding shelf is in pivotable connection with the left-side panel and the front panel proximal to a bottom of the first opening in the front panel. The first folding shelf has a pivotable fold along a diagonal axis bisecting the first folding shelf. The first folding shelf transitions between a collapsed flattened configuration between the left-side panel and front panel and a deployed configuration, where the first folding shelf is positioned perpendicular to the left-side panel and the front panel proximal to the bottom of the first opening.

The second folding shelf is in pivotable connection with the left-side panel and the front panel proximal to a bottom of the second opening in the front panel. The second folding shelf has a pivotable fold along a diagonal axis bisecting the second folding shelf. The second folding shelf transitions between a collapsed flattened configuration between the left-side panel and front panel and a deployed configuration, where the second folding shelf is positioned perpendicular to the left-side panel and the front panel proximal to the bottom of the second opening.

When the foldable frame, first folding shelf, and second folding shelf are in the deployed configurations, the deployed standing display configuration of the foldable frame maintains and locks the deployed configuration of the first and second folding shelves into place, while the deployed configuration of the first and second folding shelves maintains and locks the foldable frame in the deployed standing display configuration.

In accordance with aspects of the invention, the frame comprises a sheet of foldable material having at least three fold lines along a length dimension of the sheet defining the left-side panel, front panel, right-side panel, and back panel and wherein a fold in the fold lines provides the pivotable connection between the panels. In some such aspects, the foldable material comprises cardboard. In certain such aspects, the pivotable connection between the back panel and the left-side panel comprises a fold at a fold line defining a tab on the sheet located on an edge of the left-side panel opposite the fold line and fold that comprises the pivotable connection to the front panel that is secured to an edge of the back panel opposite the fold line and fold that comprises the pivotable connection to the right-side panel.

In accordance with aspects of the invention, the first and second folding shelves comprise a sheet of foldable material having a fold line comprising the pivotable fold along the diagonal axis bisecting the shelf and wherein the pivotable connections to the left-side panel and front panel comprise folds at fold lines defining tabs on sides of the folding shelf that are secured to the left-side panel and front panel. In some such aspects, the first and second folding shelves further comprise a top panel of foldable material attached to a diagonally bisected portion of the folding shelf. The top panel further includes two or more tabs along a back edge of the folding shelf for securing the shelf when in a deployed configuration and an angled fold line along a depth dimension of the shelf configured to allow a portion of the top panel having at least one of the two or more tabs to be folded over the shelf when in a collapsed flattened configuration.

In accordance with aspects of the invention, the erectable display further includes a first folding shelf support and a second folding shelf support. The first folding shelf support is pivotably connected to the right-side panel and the back panel in proximity to a bottom of the first opening in the front panel. The first folding shelf support has a pivotable fold along a diagonal axis bisecting the shelf support. The first folding shelf support transitions between a collapsed flattened configuration between the right panel and back panel and a deployed configuration, where the first folding shelf support is positioned perpendicular the right-side panel and the back panel below the first folding shelf proximal to the bottom of the first opening. The second folding shelf support is pivotably connected to the right-side panel and the back panel in proximity to a bottom of the second opening in the front panel. The second folding shelf support has pivotable fold along a diagonal axis bisecting the shelf support, wherein the second folding shelf support transitions between a collapsed flattened configuration between the right-side panel and back panel and a deployed configuration, where the second folding shelf support is positioned perpendicular the right-side panel and back panel below the second folding shelf proximal to the bottom of the second opening. In some such aspects, the first folding shelf support and the second folding shelf support comprise a sheet of foldable material having a fold line comprising the pivotable fold along the diagonal axis bisecting the shelf support and wherein the pivotable connections to the right-side panel and back panel comprise folds at fold lines defining tabs on sides of the folding shelf support that are secured to the right-side panel and back panel.

In accordance with aspects of the invention, the left-side panel and right-side panel further comprises a top reinforcement tab defined by a fold line along a width dimension of the panel, wherein the top reinforcement tab is folded over and secured to the panel along the fold line.

In accordance with aspects of the invention, the front panel further include a first set of outward folding tabs, a first securing tab, a first reinforcement tab, s second set of outward folding tabs, a second securing tab, and a bottom reinforcement tab. The first set of outward folding tabs are defined by fold lines along a length dimension on sides of the first opening, wherein the outward folding tabs are folded out from the first opening and secured to the left-side panel and right-side panel of the foldable frame. The first securing tab is defined by a fold line along a width dimension at a bottom of the first opening; wherein the first securing tab is folded over into the deployed standing display configuration of the foldable frame to secure the first folding shelf in a deployed configuration. The first reinforcement tab is defined by a fold line along a width dimension at a top of the second opening; wherein the first reinforcement tab is folded over and secured to the front panel providing a reinforced area where the first folding shelf is pivotably connected to the front panel. The second set of outward folding tabs are defined by fold lines along a length dimension on sides of the second opening, wherein the outward folding tabs are folded out from the second opening and secured to the left-side panel and right-side panel of the foldable frame. The second securing tab is defined by a fold line along a width dimension at a bottom of the second opening; wherein the second securing tab is folded over into the deployed standing display configuration of the foldable frame to secure the second folding shelf in a deployed configuration. The bottom reinforcement tab is defined by a fold line along a width dimension at a bottom of the front side panel; wherein the reinforcement tab is folded over and secured to the front panel providing a reinforced area where the second folding shelf is pivotably connected to the front panel.

In accordance with aspects of the invention, the back panel comprises a top reinforcement tab defined by a fold line with cut-outs along a width dimension of the panel, wherein the top reinforcement tab is folded over into the deployed standing display configuration of the frame.

In accordance with aspects of the invention, the display further includes a header panel attached to the foldable frame in the deployed standing display configuration using the cut-outs in the top reinforcement tab.

In accordance with aspects of the invention, the front panel of the folding frame further comprises a third opening disposed in the front panel and with the display having a third folding shelf. The third folding shelf is pivotably connected to the left-side panel and the front panel proximal to a bottom of the third opening in the front panel. The third folding shelf has a pivotably fold along a diagonal axis bisecting the shelf, wherein the third folding shelf transitions between a collapsed flattened configuration between the left-side panel and the front panel and a deployed configuration where the third folding shelf is positioned perpendicular to the left-side panel and the front panel proximal to the bottom of the third opening. In some such aspects, the third folding shelf comprises a sheet of foldable material having a fold line comprising the pivotable fold along the diagonal axis bisecting the shelf and wherein the pivotable connections to the left-side panel and the front panel comprise folds at fold lines defining tabs on sides of the folding shelf that are secured to the left-side panel and front-side panel. In certain aspects, the third folding shelf further comprises a top panel of foldable material attached to a diagonally bisected portion of the folding shelf. The top panel further comprises two or more tabs along a back edge of the folding shelf for securing the shelf when in a deployed configuration, and an angled fold line along a depth dimension of the shelf configured to allow a portion of the top panel having at least one of the two or more tabs to be folded over the shelf when in a collapsed flattened configuration.

In further accordance with such aspects of the invention, the display further includes a third folding shelf display. The third folding shelf support is pivotably connected to the right-side panel and the back panel in proximity to a bottom of the third opening in the front panel. The third folding shelf support has a pivotable fold along a diagonal axis bisecting the shelf support, wherein the third folding shelf support transitions between a collapsed flattened configuration between the right-side panel and the back panel and a deployed configuration where the third folding shelf support is positioned perpendicular the right-side panel and the back panel below the third folding shelf proximal to the bottom of the third opening. In some such embodiments, the third folding shelves support comprise a sheet of foldable material having a fold line comprising the pivotably fold along the diagonal axis bisecting the shelf support and wherein the pivotable connections to the right-side panel and the back panel comprise folds at fold lines defining tabs on sides of the folding shelf support that are secured to the right-side panel and the back panel.

In further accordance with such aspects of the invention, the front side panel further includes a first set of outward folding tabs, a first securing tab, a first reinforcement tab, a second set of outward folding tabs, a second securing tab, a second reinforcement tab, a third set of outward folding tabs, a third securing tab, and a bottom reinforcement tab. The first set of outward folding tabs are defined by fold lines along a length dimension on sides of the first opening, wherein the outward folding tabs are folded out from the first opening and secured to the left-side panel and the right-side panel of the foldable frame. The first securing tab is defined by a fold line along a width dimension at a bottom of the first opening, wherein the first securing tab is folded over into the deployed standing display configuration of the foldable frame to secure the first folding shelf in a deployed configuration. The first reinforcement tab is defined by a fold line along a width dimension at a top of the second opening, wherein the reinforcement tab is folded over and secured to the front panel providing a reinforced area where the first folding shelf is pivotably connected to the front panel. The second set of outward folding tabs are defined by fold lines along a length dimension on sides of the second opening, wherein the outward folding tabs are folded out from the second opening and secured to the left-side panel and right-side panel of the foldable frame. The second securing tab is defined by a fold line along a width dimension at a bottom of the second opening, wherein the second securing tab is folded over into the deployed standing display configuration of the foldable frame to secure the second folding shelf in a deployed configuration. The second reinforcement tab is defined by a fold line along a width dimension at a top of the third opening, wherein the second reinforcement tab is folded over and secured to the front panel providing a reinforced area where the second folding shelf is pivotably connected to the front panel. The third set of outward folding tabs are defined by fold lines along a length dimension on sides of the third opening, wherein the outward folding tabs are folded out from the third opening and secured to the left-side panel and right-side panel of the foldable frame. The third securing tab is defined by a fold line along a width dimension at a bottom of the third opening, wherein the third securing tab is folded over into the deployed standing display configuration of the foldable frame to secure the third folding shelf in a deployed configuration. The bottom reinforcement tab is defined by a fold line along a width dimension at a bottom of the front side panel, wherein the reinforcement tab is folded over and secured to the front panel providing a reinforced area where the third folding shelf is pivotably connected to the front panel.

In accordance with example embodiments of the present invention, a method of deploying an erectable shelf display is provided. The method comprises providing an erectable shelf display as described herein in the collapsed flattened configuration and pressing on the side panels of the foldable frame to transition the folding shelf display from the collapsed flattened configuration to the deployed standing display configuration wherein the first and second shelves are also transitioned from flattened configuration to a deployed configuration.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
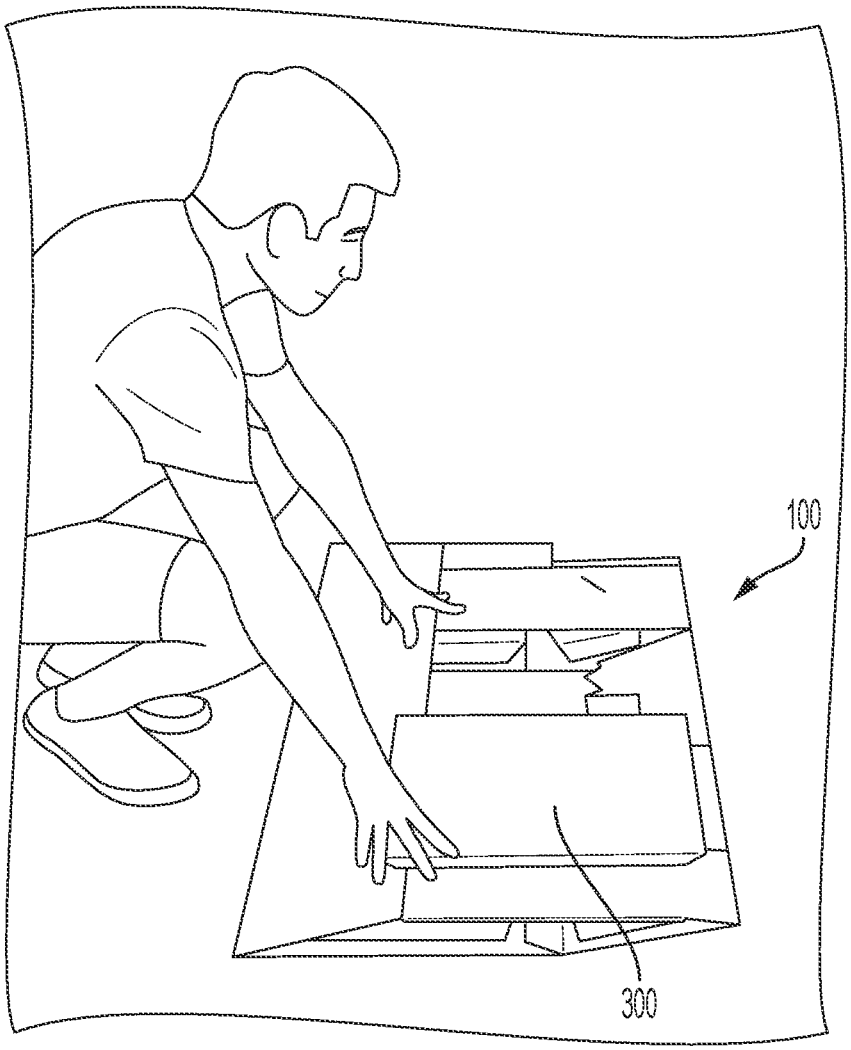
FIG. 1 depicts an erectable shelf display with an attachable header panel in a collapsed flattened configuration used for shipping and storage in accordance with embodiments of the present invention.

An illustrative embodiment of the present invention relates to an erectable shelf display that can transition between a collapsed flattened configuration and a deployed standing display configuration simply and quickly without the need for tools or complicated instruction. The erectable shelf display makes use of a foldable frame and folding shelves that work in conjunction to allow the erectable shelf to have a collapsed flattened configuration for storage and transportation and a deployed standing display configuration wherein the foldable frame maintains and locks the deployed configuration of the shelves into place, while the deployed configuration of the shelves maintains and locks the foldable frame in the deployed standing display configuration. This allows the erectable shelf display to be formed of lighter, less durable, and/or disposable materials typically used for temporary displays but still support weight comparative to a permanent display and have durability more comparable to a permanent display.

FIG. 1 through FIG. 14 wherein like parts are designated by like reference numerals throughout, illustrate an example embodiment or embodiments of an erectable shelf display, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

Figure 2:
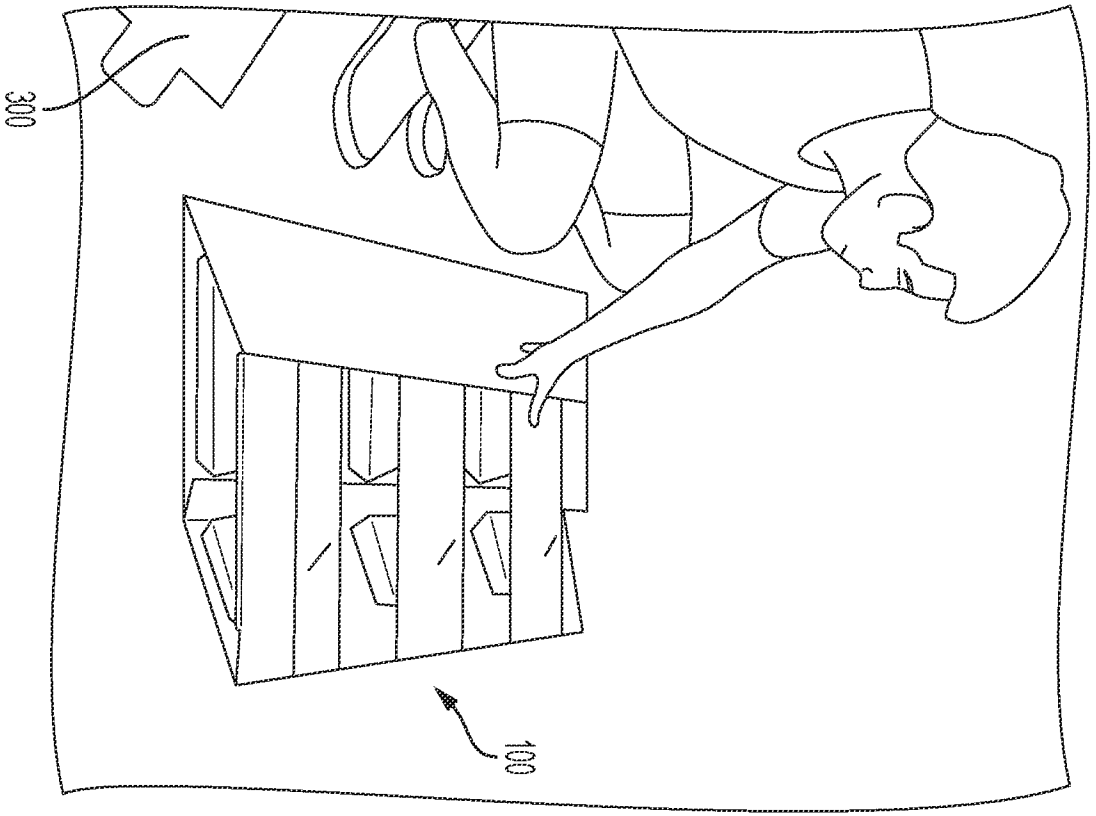
FIG. 2 depicts another view of the erectable shelf display in the collapsed flattened configuration in accordance with embodiments of the present invention.

FIG. 1 and FIG. 2 depict an erectable shelf display 100 of the present invention in a collapsed flattened configuration. FIG. 1 depicts how the erectable shelf display 100 is shipped to or otherwise provided to the site or location the display 100 is being deployed and used. Here the provided kit for the display 100 includes a header panel 300 that can be attached to the deployed standing configuration of the display 100. FIG. 2 shows the header panel 300 being removed for the deployment of the display 100.

Figure 3A:
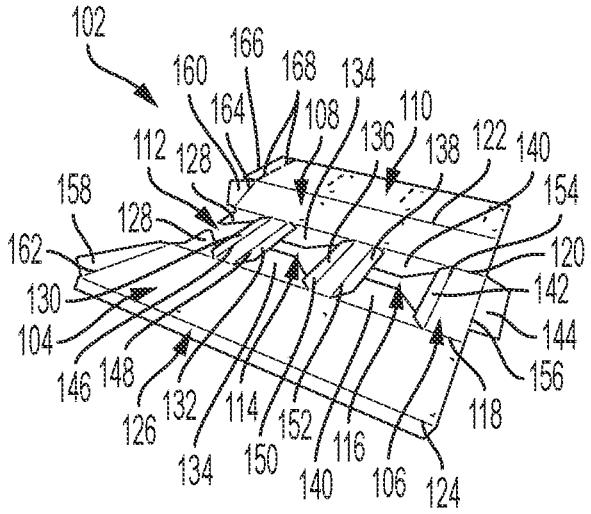
FIGS. 3A, 3B, and 3C depict a foldable frame of the erectable shelf display and its assembly in accordance with embodiments of the present invention.
Figure 3B:
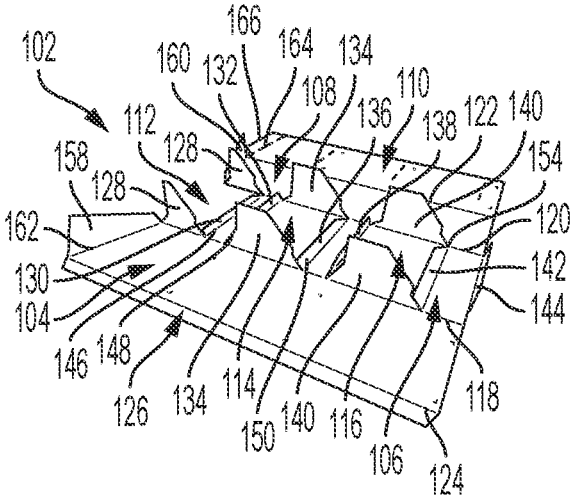
Figure 3C:
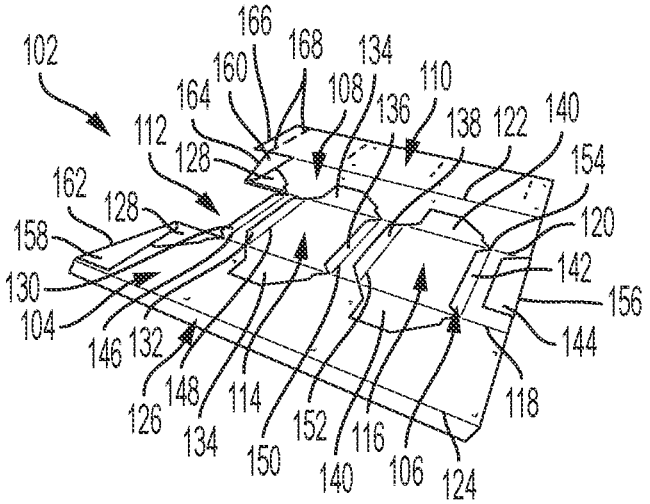

FIGS. 3A-3C depict the assembly of the frame 102 of the erectable shelf display 100. The frame includes a left-side panel 104, a front panel 106, a right-side panel 108, and a back panel 110. The front panel 106 is in pivotable connection with the left-side panel 104. The right-side panel 108 is in pivotable connection with the front panel 106. The back panel 110 is in pivotable connection with the right-side panel 108. The front panel 106 also includes a first opening 112 and a second opening 114 disposed in the front panel 106. It should be understood that the front panel can include any number of openings (accommodating any number of shelves). In the example of FIGS. 3A-3C, the front panel further includes a third opening 116 disposed in the front panel.

In certain embodiments, such as seen here, the frame 102 comprises a sheet of foldable material having at least three fold lines 118, 120, 122 along a length dimension of the sheet defining the left-side panel 104, front panel 106, right-side panel 108, and back panel 110 and wherein a fold in the fold lines 118, 120, 122 provides the pivotable connection between the panels. This example further includes a fold line 124 defining a tab 126 on the sheet located on an edge of the left-side panel 104 opposite the fold line 118 and a fold that comprises the pivotable connection to the front panel 106. This tab 126 is secured to an edge of the back panel 110 opposite the fold line 122 and fold that comprises the pivotable connection to the right-side panel 108. The fold in this fold line 124 provides a pivotable connection between the back panel 110 and the left-side panel 104.

The foldable material can be formed of corrugated fiberboard, cardboard, plastic, or other suitable material that is foldable but has sufficient structural rigidity to maintain its form and support weight on the display 100. The securing of tabs, panels, and other components is performed by gluing the components together. Other suitable adhesives or fastening means will be apparent to one skilled in the art given the benefit of this disclosure.

In some embodiments, each opening 112, 114, 116 of the front panel further comprises one or more of a set outward folding tabs, a securing tab, and a reinforcing tab. In the example of FIGS. 3A-3C there are a first set of outward folding tabs 128, a first securing tab 130, a first reinforcement tab 132, a second set of outward folding tabs 134, a second securing tab 136, a second reinforcement tab 138, a third set of outward folding tabs 140, a third securing tab 142, and a bottom reinforcement tab 140.

The first set of outward folding tabs 128 are defined by fold lines 118 and 120 along the length dimension sides of the first opening 112 as seen in FIG. 3A. The first outward folding tabs 128 are folded out from the first opening 112 as seen in FIG. 3B and folded over and secured to the left-side panel 104 and the right-side panel 108 of the foldable frame 102 as seen in FIG. 3C.

The first securing tab 130 is defined by a fold line 146 along a width dimension at the bottom of the first opening 112. The first securing tab 130 is folded over into the deployed standing display configuration of the foldable frame 102 to secure a first folding shelf in a deployed configuration.

The first reinforcement tab 132 is defined by a fold line 148 along a width dimension at the top of the second opening 114. The first reinforcement tab 132 is folded out of the second opening 114 as seen in FIG. 3B and folded over and secured to the front panel 106 as seen in FIG. 3C providing a reinforced area where the first folding shelf is pivotably connected to the front panel 106.

The second set of outward folding tabs 134 is defined by fold lines 118 and 120 along the length dimension sides of the second opening 114 as seen in FIG. 3A. The second outward folding tabs 128 are folded out from the second opening 114 as seen in FIG. 3B and folded over and secured to the left-side panel 104 and the right-side panel 108 of the foldable frame 102 as seen in FIG. 3C.

The second securing tab 136 is defined by a fold line 150 along a width dimension at the bottom of the second opening 114. The second securing tab 136 is folded over into the deployed standing display configuration of the foldable frame 102 to secure a second folding shelf in a deployed configuration.

The second reinforcement tab 138 is defined by a fold line 152 along a width dimension at the top of the third opening 116. The second reinforcement tab 138 is folded out of the third opening 116 as seen in FIG. 3B and folded over and secured to the front panel 106 as seen in FIG. 3C providing a reinforced area where the second folding shelf is pivotably connected to the front panel 106.

The third set of outward folding tabs 140 is defined by fold lines 118 and 120 along the length dimension sides of the third opening 116 as seen in FIG. 3A. The third outward folding tabs 140 are folded out from the third opening 116 as seen in FIG. 3B and folded over and secured to the left-side panel 104 and the right-side panel 108 of the foldable frame 102 as seen in FIG. 3C.

The third securing tab 142 is defined by a fold line 154 along a width dimension at the bottom of the third opening 116. The third securing tab 142 is folded over into the deployed standing display configuration of the foldable frame 102 to secure a third folding shelf in a deployed configuration.

The bottom reinforcement tab 144 is defined by a fold line 156 along a width dimension at the bottom of the front panel 106. The bottom reinforcement tab 144 is folded up as seen in FIG. 3B and folded over and secured to the front panel 106 as seen in FIG. 3C providing a reinforced area where the third folding shelf is pivotably connected to the front panel 106.

It should be understood that in embodiments with fewer than three shelves the bottom reinforcement tab replaces the respective last supporting tab, for example, the second support tab 138. Similarly, with embodiments with more than three shelves, the bottom reinforcement tab serves at the support tab for the bottom-most shelf.

In some embodiments, such as seen in FIG. 3A, the left-side panel 104 and right-side panel 108 further comprise a top reinforcement tab 158, 160 defined by a fold line 162, 164 along a width dimension of the panel, wherein the top reinforcement tab 158, 160 is up as seen in FIG. 3B and folded over and secured to the panel along the fold line 162, 164 as seen in FIG. 3C.

In some embodiments, such as seen in FIG. 3A, the back panel 110 further comprises a securing tab 166 defined by a fold line 164 with cut-outs 168 along a width dimension of the panel 110. The securing tab 166 is folded over into the deployed standing display configuration of the foldable frame 102 in a deployed configuration.

The erectable shelf display 100 further includes a first folding shelf 170 and second folding shelf 172. It should be understood that the erectable shelf display 100 can include any number of shelves. In the depicted examples, the erectable shelf display 100 further includes a third folding shelf 174. FIGS. 4A-4F depict the components and assembly of the folding shelves 170, 172, 174.

In this example, each shelf 170, 172, 174 includes a sheet of foldable material having a fold line 200 comprising a pivotable fold along a diagonal axis bisecting the sheet of the folding shelf 170, 172, 174. Tabs 202, 204 are defined by fold lines 206, 208 on the sides of the sheet. Folds at the fold lines 206, 208 provide a pivotable hinge connection to the left-side panel 104 and front panel 106 of the frame 102.

Figure 4A:
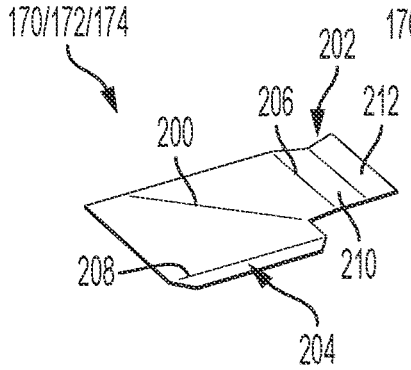
FIGS. 4A, 4B, 4C, 4D, 4E, and 4F depict a folding shelf of the erectable shelf display and its assembly in accordance with embodiments of the present invention.
Figure 4B:
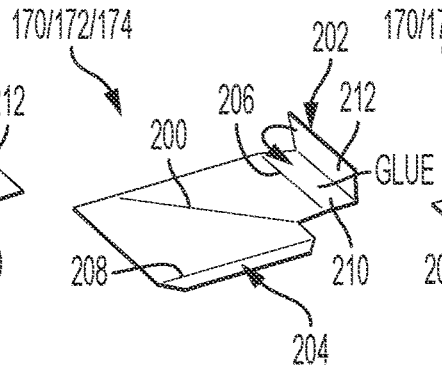
Figure 4C:
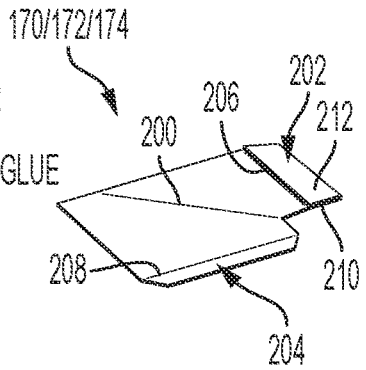

In this example, tab 202 is a reinforced tab formed from a first portion 210 and second portion 212 as shown in FIG. 4A. To form tab 202, glue or another adhesive is applied to the surface of the first portion 210 while the second portion 212 is folded up as seen in FIG. 4B. In FIG. 4C the second portion 212 is folded onto and secured to the first portion 210 using the glue or adhesive to form tab 202.

In certain embodiments, the folding shelf 170, 172, 174 further comprises a top panel 214 of foldable material. The top panel 214 further comprises two or more tabs 216 along a back edge of the folding shelf for securing the shelf when in a deployed configuration and an angled fold line 218 along a depth dimension of the shelf 170, 172, 174 configured to allow a portion 220 of the top panel 214 having at least one of the two or more tabs 216 to be folded over the shelf 170, 172, 174 when in a collapsed flattened configuration.

Figure 4D:
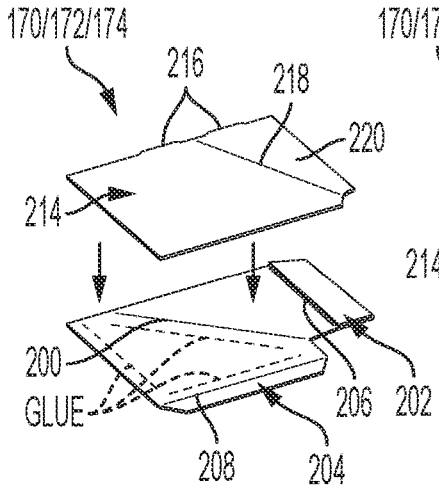
Figure 4E:
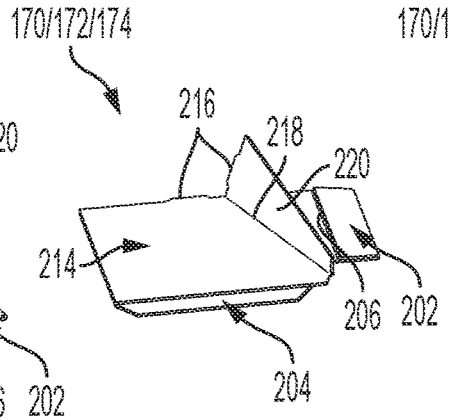
Figure 4F:
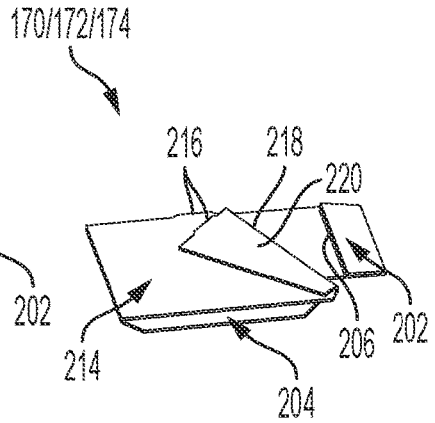

The top panel 214 is attached to a diagonally bisected portion of the folding shelf 170, 172, 174 using glue or another adhesive as seen in FIG. 4D. FIG. 4E shows the foldable portion 220 being folded up while FIG. 4F shows the foldable portion 220 of the top panel 214 folder over onto the folding shelf 170, 172, 174.

Figure 5A:
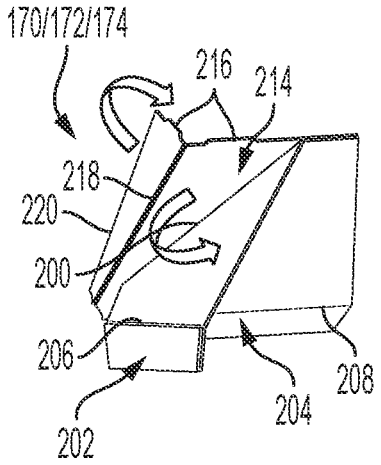
FIGS. 5A, 5B, and 5C depicts how the folding shelf folds in a collapsed state in accordance with embodiments of the present invention.
Figure 5B:
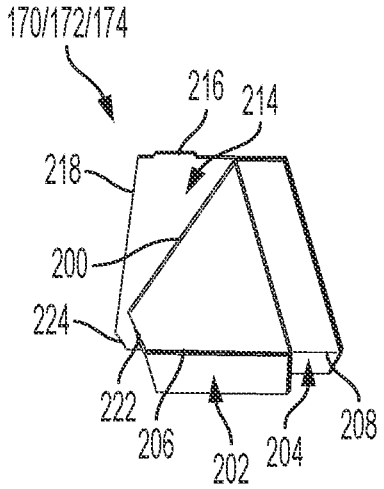
Figure 5C:
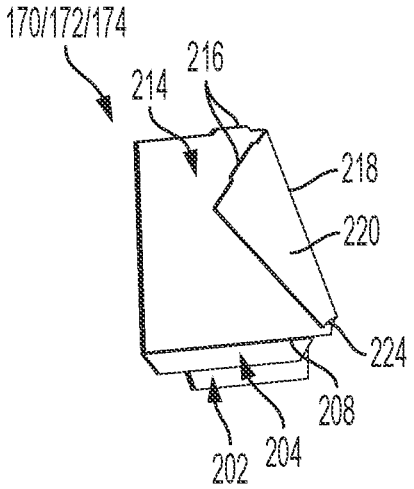

FIGS. 5A-5C show how the folding shelf 170, 172, 174 folds. FIG. 5A shows a bottom view of how a folding shelf 170, 172, 174 folds. Here the portion of the folding shelf 170, 172, 174 having tab 202 is folded along fold line 200 onto the portion of the folding shelf 170, 172, 174 having tab 204. On the top panel 214, the foldable portion 220 is folded along fold line 218 onto the rest of the top panel 214. These folds result in the folded folding shelf 170, 172, 174 in a collapsed folded state as shown in the underside view of FIG. 5B and the top view of FIG. 5C. In certain embodiments, the corner 222 of the folding shelf 170, 172, 174 and the corner 224 top panel 214 are removed to relieve bulking when the erectable display 100 is in a collapsed flattened configuration.

The foldable material can be formed of corrugated fiberboard, cardboard, plastic, or other suitable material that is foldable but has sufficient structural rigidity to maintain its form and support weight on the display 100. The securing of tabs, panels, and other components is performed by gluing the components together. Other suitable adhesives or fastening means will be apparent to one skilled in the art given the benefit of this disclosure.

In certain embodiments, the erectable shelf display 100 further includes a first folding shelf support 176 and a second folding shelf support 178. It should be understood that the erectable shelf display 100 may include a folding shelf support for every folding shelf in the display 100. In the depicted examples, the erectable shelf display 100 further includes a third folding shelf support 180. FIGS. 6A-6I depicts how the folding shelves 170, 172, 174 and folding shelf supports 176, 178, 180 are attached to the foldable frame 102 to make the erectable shelf display 100.

Figure 6A:
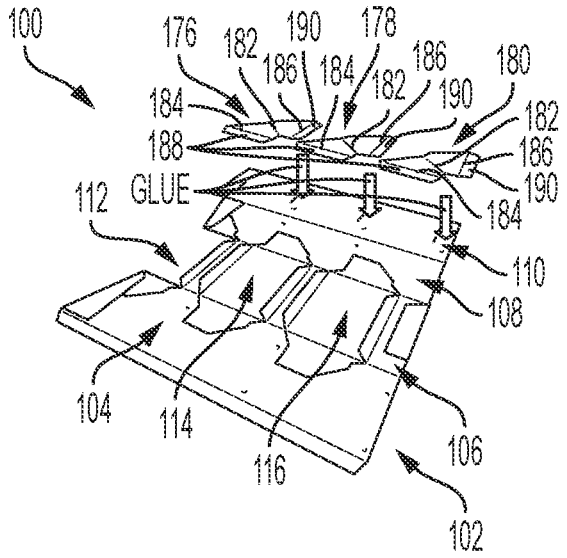
FIGS. 6A, 6B, 6C, 6D, 6E, 6F, 6G, 6H, and 6I depict the assembly of the erectable shelf display in accordance with embodiments of the present invention.

In FIG. 6A the first folding shelf support 176 is pivotably connected to the back panel 110 in proximity to a bottom of the first opening 112 in the front panel 106, the second folding shelf support 178 is pivotably connected to the back panel 110 in proximity to a bottom of the second opening 114 in the front panel 106, and the third folding shelf support 180 is pivotably connected to the back panel 110 in proximity to a bottom of the third opening 116 in the front panel 106.

In certain embodiments, each of the folding shelf support 176, 178, 180 comprise a sheet of foldable material having a fold line 182 comprising a pivotable fold along a diagonal axis bisecting the shelf support and fold lines 184, 186 defining tabs 188, 190 on the ends of the folding shelf support 176, 178, 180. Tab 190 of each shelf support 176, 178, 180 is secured to the back panel 110 in proximity to the bottom of the openings 112, 114, 116 in the front panel 106 and a fold in the fold line 186 provides a pivotable connection between the back panel 110 and the folding shelf support 176, 178, 180.

Figure 6B:
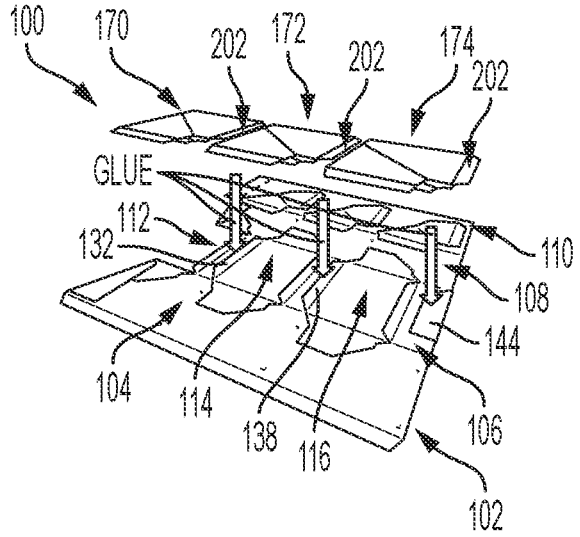

In FIG. 6B the first folding shelf 170 is pivotably connected to the front panel 106 in proximity to the bottom of the first opening 112 in the front panel 106 by securing tab 202 of the first folding shelf 170 to the reinforced area created by the first reinforcement tab 132. The second folding shelf 172 is pivotably connected to the front panel 106 in proximity to the bottom of the second opening 114 in the front panel 106 by securing tab 202 of the second folding shelf 172 to the reinforced area created by the second reinforcement tab 138. The third folding shelf 174 is pivotably connected to the front panel 106 in proximity to the bottom of the third opening 116 in the front panel 106 by securing tab 202 of the third folding shelf 174 to the reinforced area created by the bottom reinforcement tab 144.

Figure 6C:
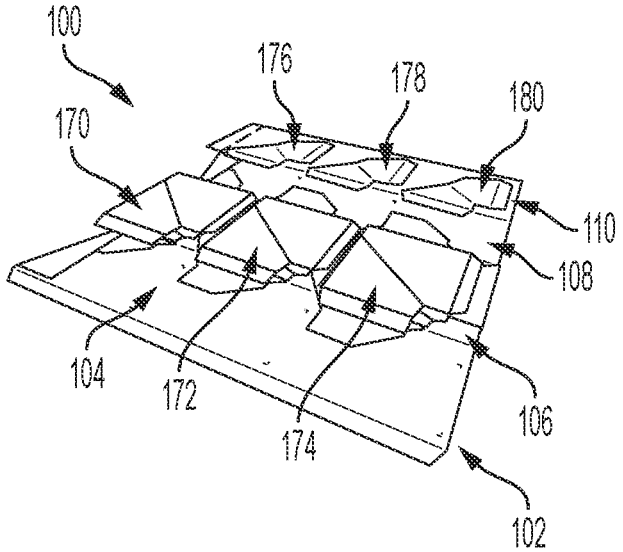

FIG. 6C depicts the shelf supports 176, 178, 180 pivotably connected to the back panel 110 and the folding shelves 170, 172, 174 pivotably coupled to the front panel 106.

Figure 6D:
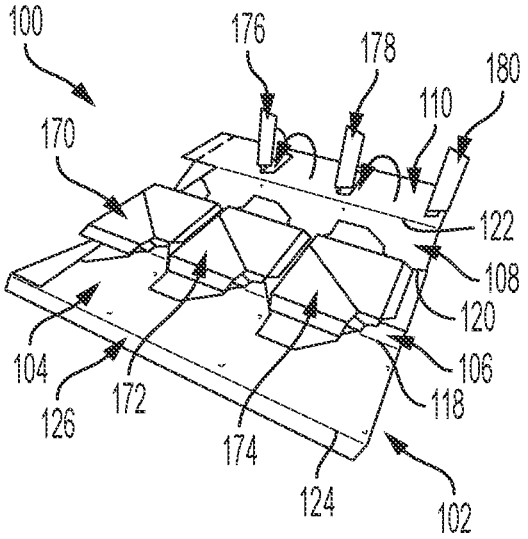

In FIG. 6D each of the shelf supports 176, 178, 180 is folded along fold line 186 to be oriented perpendicular to the back panel 110.

Figure 6E:
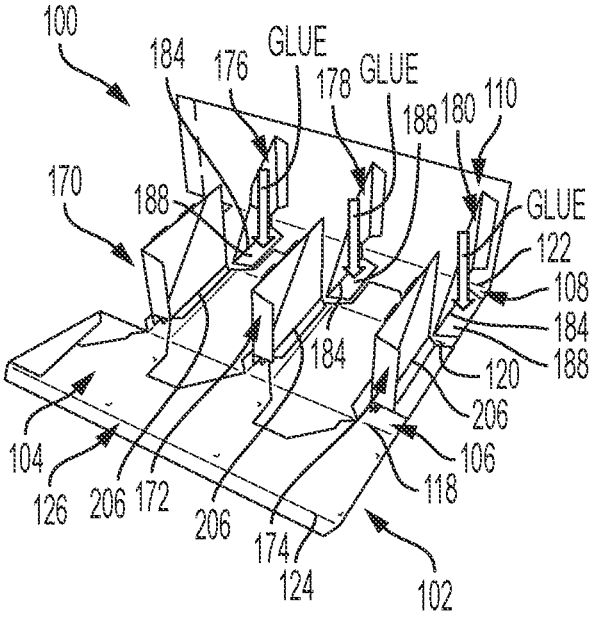

In FIG. 6E the back panel 110 is folded along fold line 122 to be oriented perpendicular to the right-side panel 108. The first shelf support 176 is pivotably connected to the right-side panel 108 in proximity to the bottom of the first opening 112 in the front panel 106 by securing tab 188 of the first shelf support 176 to the right-side panel 108 with a fold in the fold line 184 providing the pivotable connection. The second shelf support is 178 is pivotably connected to the right-side panel 108 in proximity to the bottom of the second opening 114 in the front panel 106 by securing tab 188 of the second shelf support 178 to the right-side panel 108 with a fold in the fold line 184 providing the pivotable connection. The third shelf support 180 is pivotably connected to the right-side panel 108 in proximity to the bottom of the third opening 116 in the front panel 106 by securing tab 188 of the third shelf support 180 to the right-side panel 108 with a fold in the fold line 184 providing the pivotable connection.

Also, in FIG. 6E each of the folding shelves 170, 172, 174 is folded along fold line 206 to be oriented perpendicular to the front panel 106.

Figure 6F:
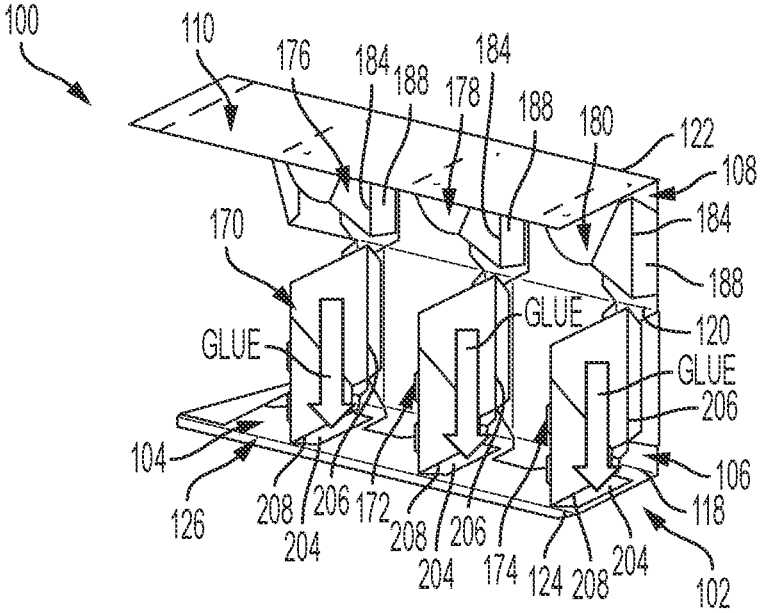

In FIG. 6F the front panel 106 is folded along fold line 118 to orient the front panel 106 and the right-side panel 108 perpendicular to the left-side panel 104 and the back panel 110 parallel to the left-side panel 104. The first folding shelf 170 is pivotably connected to the left-side panel 104 in proximity to the bottom of the first opening 112 in the front panel 106 by securing tab 204 of the first folding shelf 170 to the left-side panel 104 with a fold in the fold line 208 providing the pivotable connection. The second folding shelf 172 is pivotably connected to the left-side panel 104 in proximity to the bottom of the second opening 114 in the front panel 106 by securing tab 204 of the second folding shelf 172 to the left-side panel 104 with a fold in the fold line 208 providing the pivotable connection. The third folding shelf 174 is pivotably connected to the left-side panel 104 in proximity to the bottom of the third opening 116 in the front panel 106 by securing tab 204 of the third folding shelf 174 to the left-side panel 104 with a fold in the fold line 208 providing the pivotable connection.

Figure 6G:
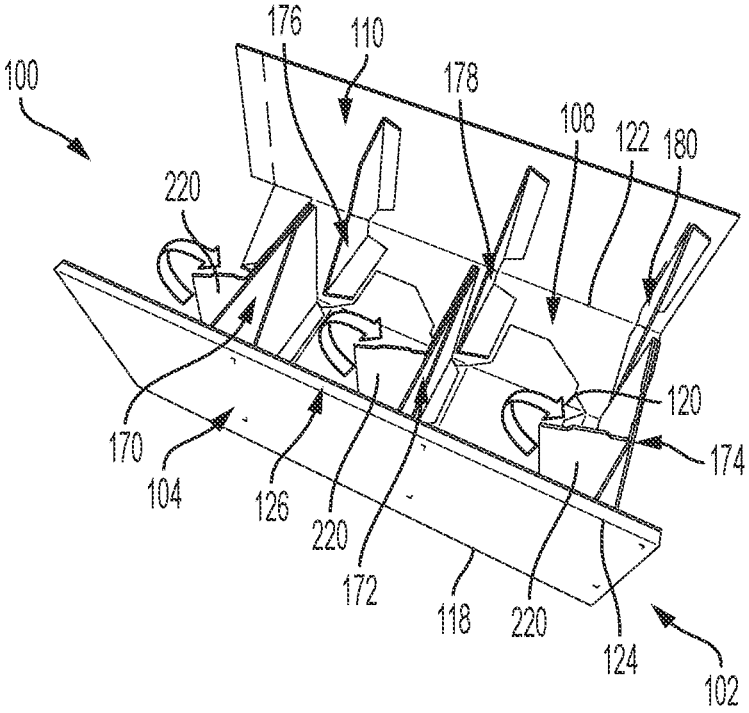

In FIG. 6G the foldable portion 220 of the top panel 214 of each of the folding shelve 170, 172, 174 is folded over onto the top panel 214. The left-side panel 104 is then folded over the front panel 106 along fold line 118 while each of the folding shelves 170, 172, 174 is folded along fold line 200 transitioning the shelves 170, 172, 174 from a deployed configuration where each shelf 170, 172, 174 is perpendicular to the left-side panel 104 and front panel 106 to a collapsed configuration where the shelves 170, 172, 174 are flattened between the left-side panel 104 and the front panel 106

Figure 6H:
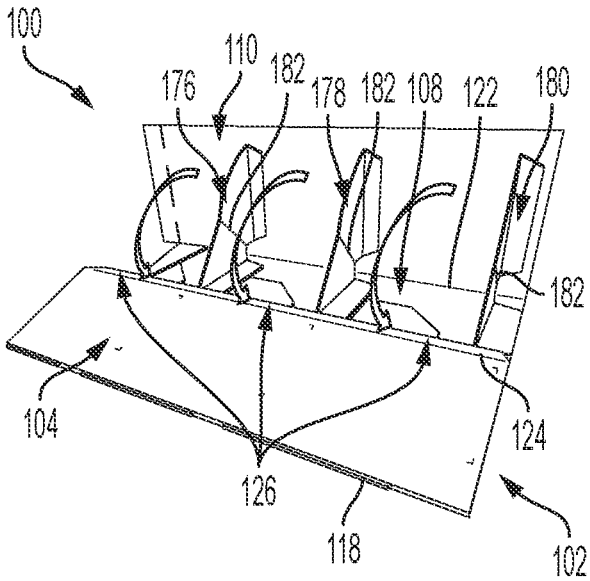

In FIG. 6H the back panel 110 is folded over the right-side panel 108 along fold line 122 while each of the folding shelf supports 176, 178, 180 is folded along fold line 182 transitioning the shelf supports 176, 178, 180 from a deployed configuration where each shelf support 176, 178, 180 is perpendicular to the right-side panel 108 and back panel 110 and front panel 106 to a collapsed configuration where the shelf supports 176, 178, 180 are flattened between the back panel 110 and the right-side panel 108.

Also, in FIG. 6H glue or another adhesive is applied to the surface of tab 126 defined by fold line 124 on the left-side panel.

Figure 6I:
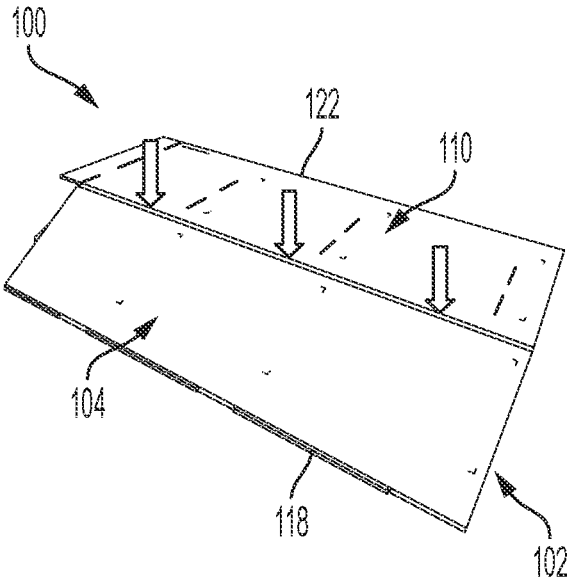

In FIG. 6I the edge of the back panel 110 opposite the fold line 122 is secured to tab 126 defined by fold line 124. The fold in this fold line 124 provides a pivotable connection between the back panel 110 and the left-side panel 104.

Figure 7A:
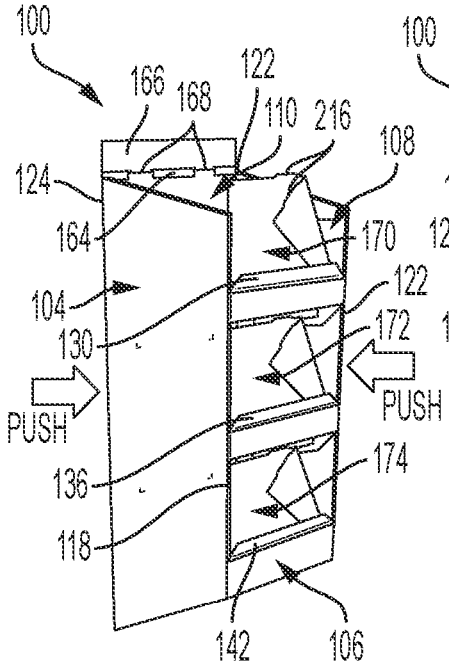
FIGS. 7A, 7B, and 7C depict how the erectable shelf display transitions from a collapsed flattened configuration to a deployed standing shelf display configuration in accordance with embodiments of the present invention.
Figure 7B:
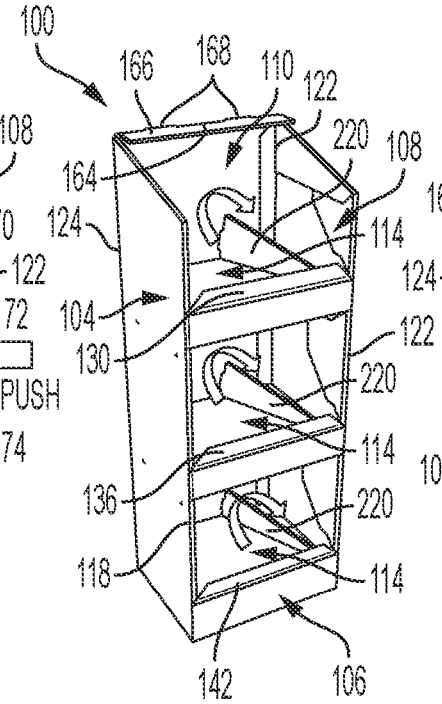
Figure 7C:
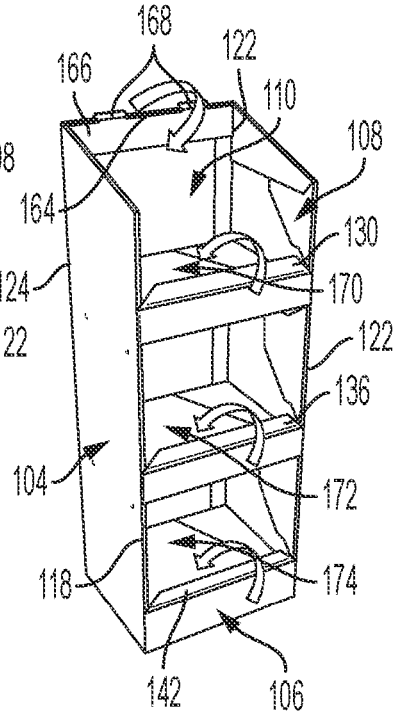

FIGS. 7A-7C depict the process of transitioning an erectable shelf display 100 from the collapsed flattened state as seen in FIGS. 1, 2, and 6I to a deployed standing configuration. In FIG. 7A a user pushes or presses on the left-side panel 104 and right-side panel 108 to square the foldable frame 102 such that the left-side panel 104 and right-side panel 108 are parallel to each other and perpendicular to the front panel 106 and back panel 110 which are parallel to each other. This positioning of the panels 104, 106, 108, 110 also serves to transition the folding shelves 170, 172, 174 and the folding shelf supports 176, 178, 180 from the collapsed configuration to the deployed configuration. The interrelation of the folding shelves 170, 172, 174 and the folding shelf supports 176, 178, 180 during deployment can be seen in FIGS. 8A-8C.

Figure 8A:
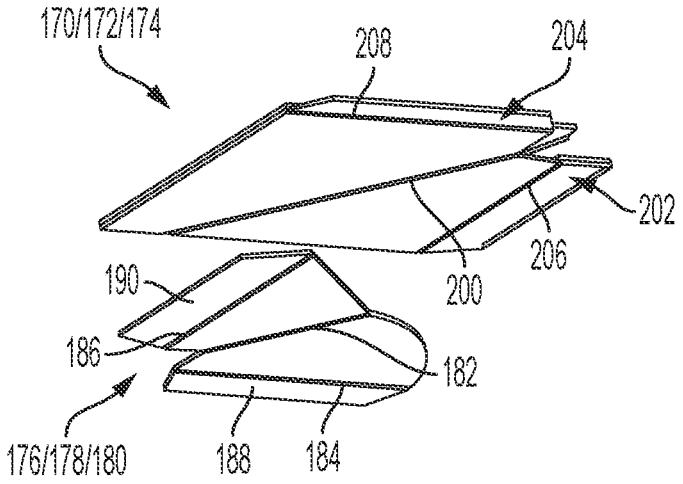
FIGS. 8A, 8B, and 8C depict the interaction of a folding shelf and a folding shelf support in accordance with embodiments of the present invention.

FIG. 8A depict how each folding shelf support 176, 178, 180 is deployed under their respective folding shelf 170, 172, 174. That is, the first shelf support 176 is deployed bellow the first folding shelf 170, the second shelf support 178 is deployed below the second folding shelf 172, and the third shelf support 180 is deployed below the third folding shelf 174.

Figure 8B:
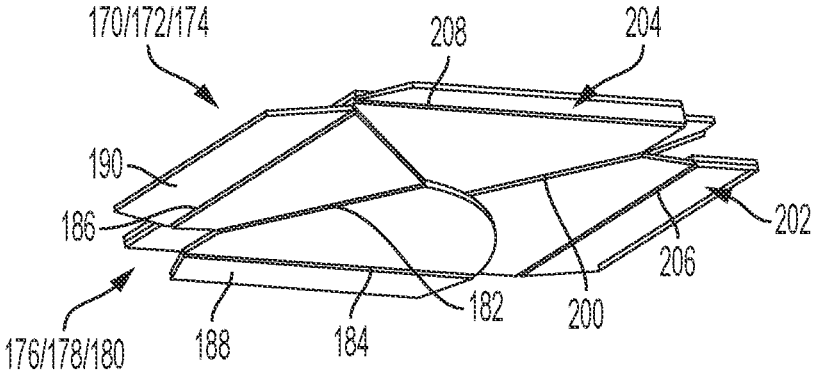

FIG. 8B depicts how each folding shelf support 176, 178, 180 is oriented opposite the orientation of the corresponding folding shelf 170, 172, 174 it supports to provide greater strength and support.

Figure 8C:
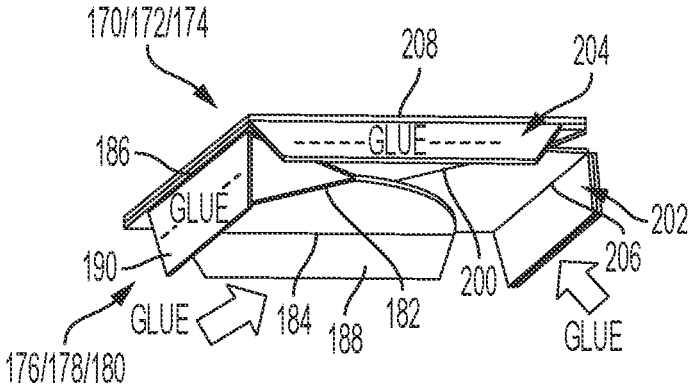
Figure 9:
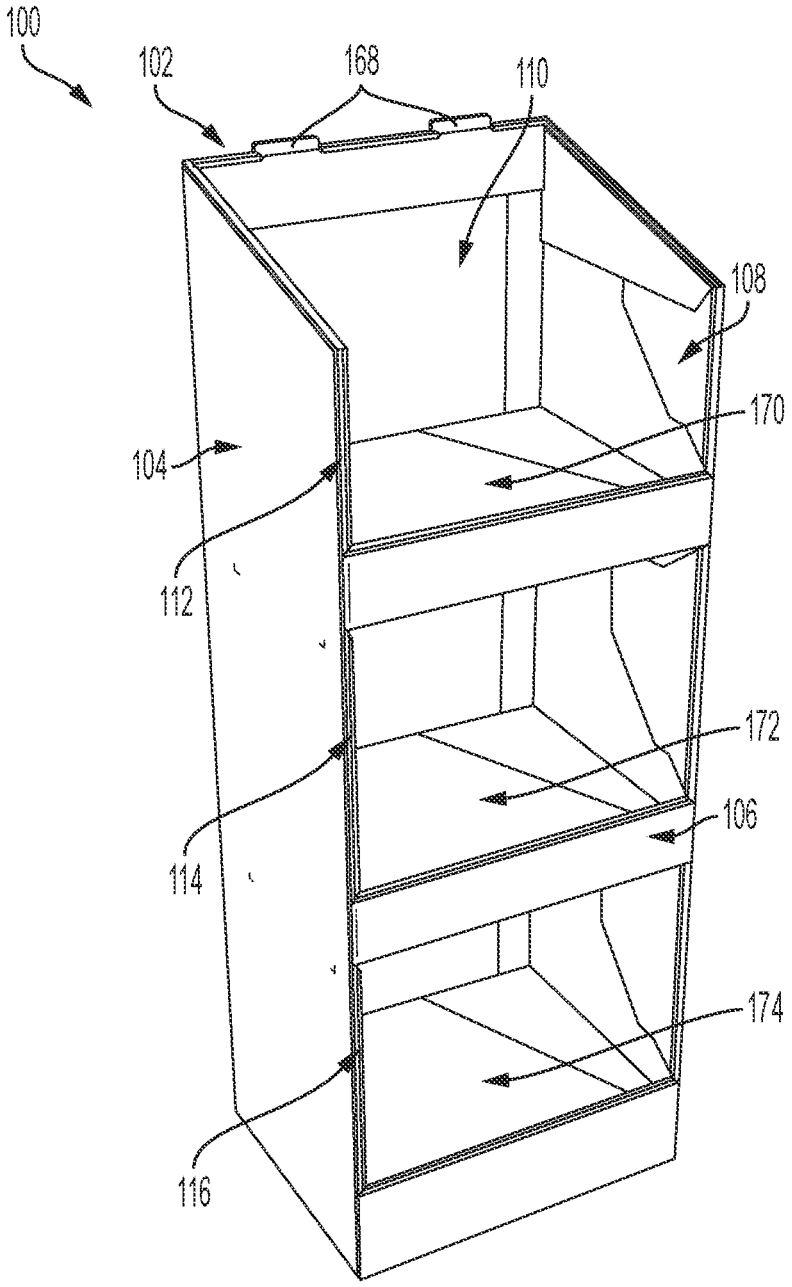
FIG. 9 depicts the erectable shelf display in a deployed standing shelf display configuration in accordance with embodiments of the present invention.
Figure 10:
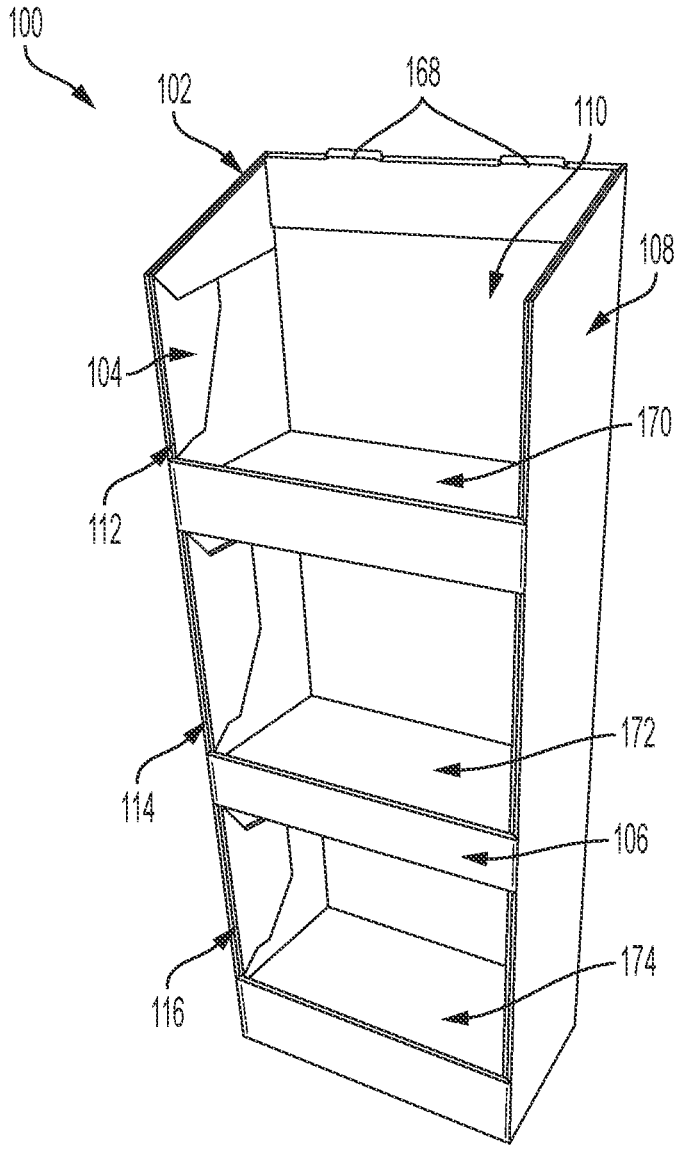
FIG. 10 depicts another view of the erectable shelf display in a deployed standing shelf display configuration in accordance with embodiments of the present invention.

FIG. 8C depicts how each folding shelf 170, 172, 174 is pivotably coupled to the front panel 106 via glue or other adhesive applied to tab 202 and pivotably coupled to the left-side panel 104 via glue or other adhesive applied to tab 204. Each shelf support 176, 178, 180 is pivotably connected to the back panel 110 via glue or other adhesive applied to tab 190 and pivotably coupled to the right-side panel 108 via glue or other adhesive applied to tab 188.

Returning to FIG. 7B, the foldable portion 220 of the top shelf is unfolded so that the tabs 216 on each folding shelf 170, 172, 174 secure the shelf 170, 172, 174 in the deployed configuration. Tab 166 is also folded over fold line 164 into the deployed standing shelf display 100 to engage with the secured tabs 158 and 160 to further reinforce the structure of the standing shelf display 100.

In FIG. 7C the first securing tab 130 is folded over fold line 146 into the first opening 112 to secure the first folding shelf 170 in the deployed configuration. The second securing tab 136 is folded over fold line 150 into the second opening 114 to secure the second folding shelf 172 in the deployed configuration. The third securing tab 142 is folded fold line 154 into the third opening 116 to secure the third folding shelf 174 in the deployed configuration. The resulting deployed standing shelf display 100 and be seen in FIG. 9 and FIG. 10.

Figure 11:
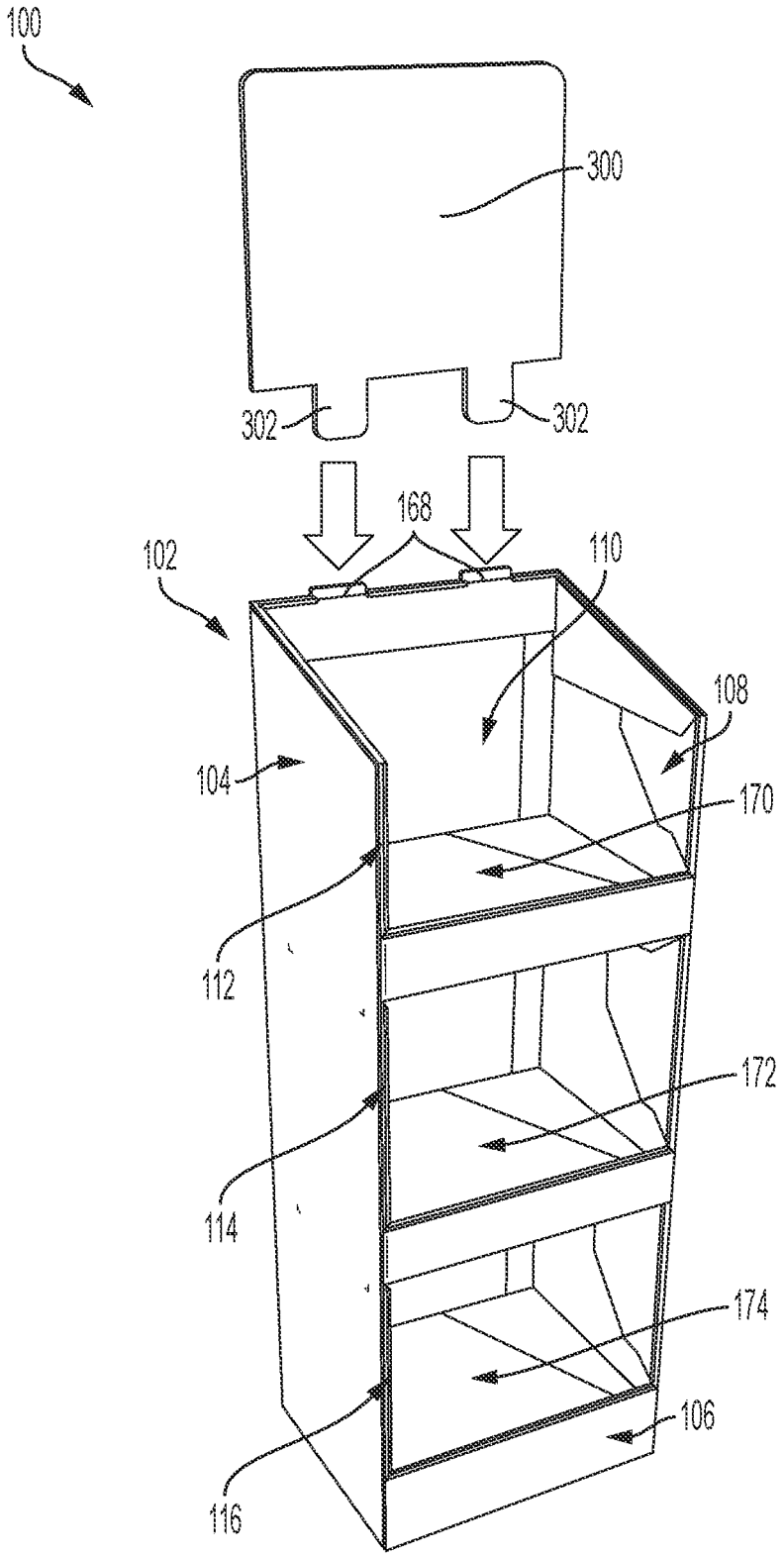
FIG. 11 depicts the attachment of a header panel to the erectable shelf display in a deployed standing shelf display configuration in accordance with embodiments of the present invention.
Figure 12:
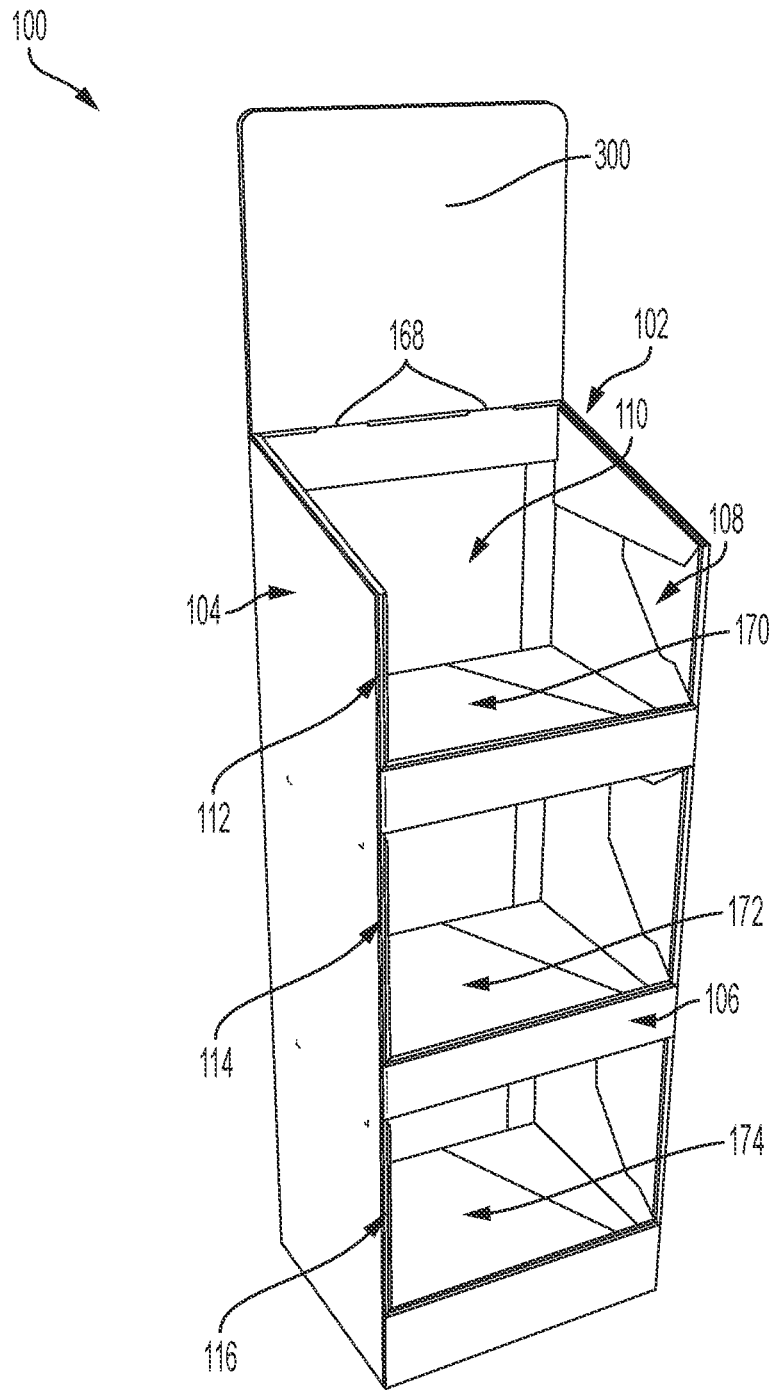
FIG. 12 depicts the erectable shelf display in a deployed standing shelf display configuration with the header panel attached in accordance with embodiments of the present invention.
Figure 13:
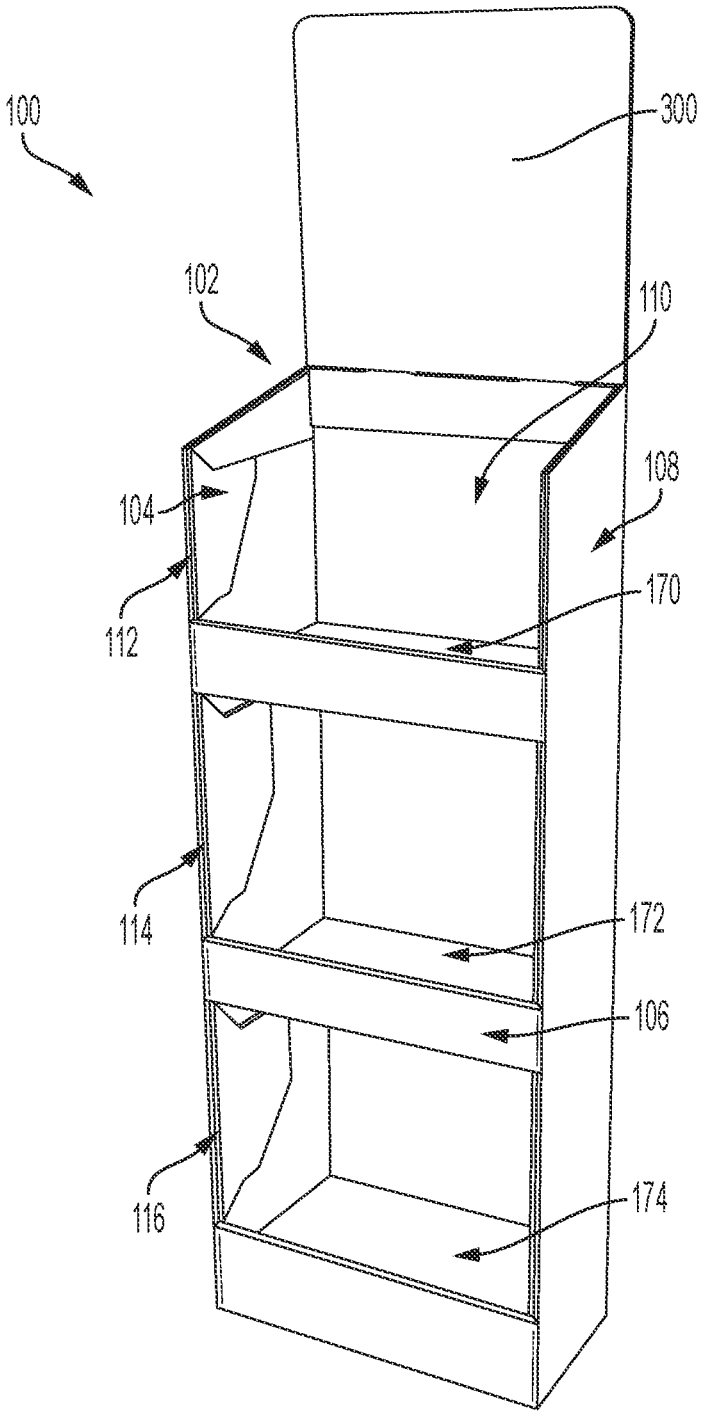
FIG. 13 depicts another view of the erectable shelf display in a deployed standing shelf display configuration with the header panel attached in accordance with embodiments of the present invention.

In certain embodiments, the erectable shelf display 100 can include an attachable header panel 300. An example of this can be seen in FIGS. 11-13. In FIG. 11 the attachable header panel 300 is shown having tabs 302 configured to engage with the cut-outs 168 or slot provided in fold line 164 defining tab 166. Examples of the resulting shelf display 100 with the attached header panel 300 can be seen in FIG. 12 and FIG. 13.

Figure 14:
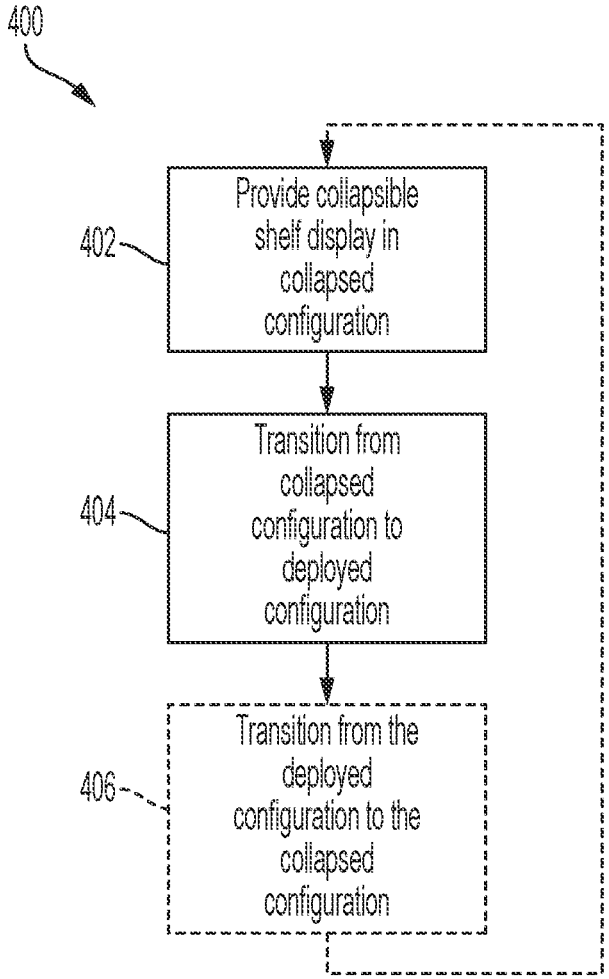
FIG. 14 depicts a methodology for using an erectable display in accordance with embodiments of the present invention.

FIG. 14 provides a high-level flow diagram for a methodology 400 for using an erectable shelf display 100 between a collapsed flattened configuration, such as seen in FIGS. 1, 2, and 6I, and deployed standing configuration as seen in FIGS. 9-13.

The first step in the methodology 400 is providing an erectable shelf display 100 as disclosed herein in a collapsed flattened configuration (Step 402). The provided shelf display may be assembled from its component parts as described and set forth in relation to FIGS. 3A-6I or provided to the user in an assembled collapsed state as seen in FIGS. 1-2. The next Step in the methodology 400 is transitioning the shelf display 100 from the collapsed configuration to standing deployed configuration (Step 404). This is achieved by performing the process set forth and described in relation to FIGS. 7A-7C and FIG. 11.

In certain embodiments, the deployed standing shelf display 100 can be transitioned back into a collapsed flattened configuration (Step 406). This is achieved by undoing or performing in-reverse the process set forth and described in relation to FIGS. 7A-7C and FIG. 11. The collapsed shelf display can then be stored, disposed of, or re-deployed.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about", "generally", and "approximately" are intended to cover variations that may exist in the upper and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extent or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification, embodiments have been described in a way that enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. An erectable shelf display, comprising:

a foldable frame comprising:

a left-side panel;

a front panel in pivotable connection with the left-side panel, the front panel comprising:

a first opening disposed in the front panel; and a second opening disposed in the front panel;

a right-side panel in pivotable connection with the front panel; and a back panel in pivotable connection with the right-side panel and the left-side panel;

wherein the foldable frame transitions from a collapsed flattened configuration to a deployed standing display configuration by unfolding the foldable frame at the pivotable connections between the left-side panel, the front panel, the right-side panel, and the back panel;

a first folding shelf in pivotable connection with the left-side panel and the front panel proximal to a bottom of the first opening in the front panel, the first folding shelf having a pivotable fold along a diagonal axis bisecting the first folding shelf, wherein the first folding shelf transitions between a collapsed flattened configuration between the left-side panel and front panel and a deployed configuration, where the first folding shelf is positioned perpendicular the left-side panel and front panel proximal the bottom of the first opening; and a second folding shelf in pivotable connection with the left-side panel and the front panel proximal to a bottom of the second opening in the front panel, the second folding shelf having a pivotable fold along a diagonal axis bisecting the second folding shelf, wherein the second folding shelf transitions between a collapsed flattened configuration between the left-side panel and front panel and a deployed configuration, where the second folding shelf is positioned perpendicular the left-side panel and front panel proximal to the bottom of the second opening;

wherein when the foldable frame, first folding shelf, and second folding shelf are in the deployed configurations, the deployed standing display configuration of the foldable frame maintains and locks the deployed configuration of the first and second folding shelves into place, while the deployed configuration of the first and second folding shelves maintains and locks the foldable frame in the deployed standing display configuration.

2. The erectable shelf display of claim 1 wherein the frame comprises a sheet of foldable material having at least three fold lines along a length dimension of the sheet defining the left-side panel, front panel, right-side panel, and back panel and wherein a fold in the fold lines provides the pivotable connection between the panels.

3. The erectable shelf display of claim 2, wherein the foldable material comprises cardboard.

4. The erectable shelf display of claim 2, wherein the pivotable connection between the back panel and the left-side panel comprises a fold at a fold line defining a tab on the sheet located on an edge of the left-side panel opposite the fold line and fold that comprises the pivotable connection to the front panel that is secured to an edge of the back panel opposite the fold line and fold that comprises the pivotable connection to the right-side panel.

5. The erectable shelf display of claim 1, wherein the first and second folding shelves comprise a sheet of foldable material having a fold line comprising the pivotable fold along the diagonal axis bisecting the shelf and wherein the pivotable connections to the left-side panel and front panel comprise folds at fold lines defining tabs on sides of the folding shelf that are secured to the left-side panel and front panel.

6. The erectable shelf display of claim 5, wherein the first and second folding shelves further comprise a top panel of foldable material attached to a diagonally bisected portion of the folding shelf, the top panel further comprising:

two or more tabs along a back edge of the folding shelf for securing the shelf when in the deployed configuration; and an angled fold line along a depth dimension of the shelf configured to allow a portion of the top panel having at least one of the two or more tabs to be folded over the shelf when in the collapsed flattened configuration.

7. The erectable shelf display of claim 1, further comprising:

a first folding shelf support pivotably connected to the right-side panel and the back panel in proximity to a bottom of the first opening in the front panel, the folding shelf support having a pivotable fold along a diagonal axis bisecting the shelf support, wherein the first folding shelf support transitions between a collapsed flattened configuration between the right-side panel and back panel and a deployed configuration, where the first folding shelf support is positioned perpendicular the right-side panel and the back panel below the first folding shelf proximal to the bottom of the first opening; and a second folding shelf support pivotably connected to the right-side panel and the back panel in proximity to a bottom of the second opening in the front panel, the second folding shelf support having a pivotable fold along a diagonal axis bisecting the shelf support, wherein the second folding shelf support transitions between a collapsed flattened configuration between the right-side panel and back panel and a deployed configuration, where the second folding shelf support is positioned perpendicular the right-side panel and back panel below the second folding shelf proximal to the bottom of the second opening.

8. The erectable shelf display of claim 7, wherein the first folding shelf support and the second folding shelf support comprise a sheet of foldable material having a fold line comprising the pivotable fold along the diagonal axis bisecting the shelf support and wherein the pivotable connections to the right-side panel and back panel comprise folds at fold lines defining tabs on sides of the folding shelf support that are secured to the right-side panel and back panel.

9. The erectable shelf display of claim 1, wherein the left-side panel and right-side panel further comprise a top reinforcement tab defined by a fold line along a width dimension of the panel, wherein the top reinforcement tab is folded over and secured to the panel along the fold line.

10. The erectable shelf display of claim 1, wherein the front panel further comprises:

a first set of outward folding tabs defined by fold lines along a length dimension on sides of the first opening, wherein the outward folding tabs are folded out from the first opening and secured to the left-side panel and right-side panel of the foldable frame;

a first securing tab defined by a fold line along a width dimension at a bottom of the first opening; wherein the first securing tab is folded over into the deployed standing display configuration of the foldable frame to secure the first folding shelf in the deployed configuration;

a first reinforcement tab defined by a fold line along a width dimension at a top of the second opening; wherein the first reinforcement tab is folded over and secured to the front panel providing a reinforced area where the first folding shelf is pivotably connected to the front panel;

a second set of outward folding tabs defined by fold lines along a length dimension on sides of the second opening, wherein the outward folding tabs are folded out from the second opening and secured to the left-side panel and right-side panel of the foldable frame;

a second securing tab defined by a fold line along a width dimension at a bottom of the second opening; wherein the second securing tab is folded over into the deployed standing display configuration of the foldable frame to secure the second folding shelf in the deployed configuration; and a bottom reinforcement tab defined by a fold line along a width dimension at a bottom of the front side panel; wherein the reinforcement tab is folded over and secured to the front panel providing a reinforced area where the second folding shelf is pivotably connected to the front panel.

11. The erectable shelf display of claim 1, wherein the back panel comprises a top reinforcement tab defined by a fold line with cut-outs along a width dimension of the panel, wherein the top reinforcement tab is folded over into the deployed standing display configuration of the frame.

12. The erectable shelf display of claim 11, further comprising a header panel attached to the foldable frame in the deployed standing display configuration using the cut-outs in the top reinforcement tab.

13. The erectable shelf display of claim 1, further comprising:

the front panel of the folding frame further comprising a third opening disposed in the front panel; and a third folding shelf pivotably connected to the left-side panel and the front panel proximal to a bottom of the third opening in the front panel, the third folding shelf having a pivotable fold along a diagonal axis bisecting the shelf, wherein the third folding shelf transitions between a collapsed flattened configuration between the left-side panel and the front panel and a deployed configuration where the third folding shelf is positioned perpendicular the left-side panel and the front panel proximal to the bottom of the third opening.

14. The erectable shelf display of claim 13, wherein the third folding shelf comprises a sheet of foldable material having a fold line comprising the pivotable fold along the diagonal axis bisecting the shelf and wherein the pivotable connections to the left-side panel and the front panel comprise folds at fold lines defining tabs on sides of the folding shelf that are secured to the left-side panel and front panel.

15. The erectable shelf display of claim 14, wherein the third folding shelf further comprises a top panel of foldable material attached to a diagonally bisected portion of the folding shelf, the top panel further comprising:

two or more tabs along a back edge of the folding shelf for securing the shelf when in the deployed configuration; and an angled fold line along a depth dimension of the shelf configured to allow a portion of the top panel having at least one of the two or more tabs to be folded over the shelf when in the collapsed flattened configuration.

16. The erectable shelf display of claim 13, further comprising:

a third folding shelf support pivotably connected to the right-side panel and the back panel in proximity to a bottom of the third opening in the front panel, the third folding shelf support having a pivotable fold along a diagonal axis bisecting the shelf support, wherein the third folding shelf support transitions between the collapsed flattened configuration between the right-side panel and the back panel and the deployed configuration where the third folding shelf support is positioned perpendicular the right-side panel and the back panel below the third folding shelf proximal to the bottom of the third opening.

17. The erectable shelf display of claim 16, wherein the third folding shelf support comprises a sheet of foldable material having a fold line comprising the pivotable fold along the diagonal axis bisecting the shelf support and wherein the pivotable connections to the right-side panel and the back panel comprise folds at fold lines defining tabs on sides of the folding shelf support that are secured to the right-side panel and the back panel.

18. The erectable shelf display of claim 13, wherein the front panel further comprises:

a first set of outward folding tabs defined by fold lines along a length dimension on sides of the first opening, wherein the outward folding tabs are folded out from the first opening and secured to the left-side panel and the right-side panel of the foldable frame;

a first securing tab defined by a fold line along a width dimension at a bottom of the first opening; wherein the first securing tab is folded over into the deployed standing display configuration of the foldable frame to secure the first folding shelf in the deployed configuration;

a first reinforcement tab defined by a fold line along a width dimension at a top of the second opening; wherein the reinforcement tab is folded over and secured to the front panel providing a reinforced area where the first folding shelf is pivotably connected to the front panel;

a second set of outward folding tabs defined by fold lines along a length dimension on sides of the second opening, wherein the outward folding tabs are folded out from the second opening and secured to the left-side panel and right-side panel of the foldable frame;

a second securing tab defined by a fold line along a width dimension at a bottom of the second opening; wherein the second securing tab is folded over into the deployed standing display configuration of the foldable frame to secure the second folding shelf in the deployed configuration;

a second reinforcement tab defined by a fold line along a width dimension at a top of the third opening; wherein the second reinforcement tab is folded over and secured to the front panel providing a reinforced area where the second folding shelf is pivotably connected to the front panel;

a third set of outward folding tabs defined by fold lines along a length dimension on sides of the third opening, wherein the outward folding tabs are folded out from the third opening and secured to the left-side panel and right-side panel of the foldable frame;

a third securing tab defined by a fold line along a width dimension at a bottom of the third opening; wherein the third securing tab is folded over into the deployed standing display configuration of the foldable frame to secure the third folding shelf in the deployed configuration; and a bottom reinforcement tab defined by a fold line along a width dimension at a bottom of the front side panel; wherein the reinforcement tab is folded over and secured to the front panel providing a reinforced area where the third folding shelf is pivotably connected to the front panel.

19. A method of deploying an erectable shelf display, the method comprising:

providing the erectable shelf display in a collapsed flattened configuration, the erectable shelf display comprising:

a foldable frame comprising:

a left-side panel;

a front panel in pivotable connection with the left-side panel, the front panel comprising:

a first opening disposed in the front panel; and a second opening disposed in the front panel;

a right-side panel in pivotable connection with the front panel; and a back panel in pivotable connection with the right-side panel and the left-side panel;

wherein the foldable frame transitions from the collapsed flattened configuration to a deployed standing display configuration by unfolding the foldable frame at the pivotable connections between the left-side panel, the front panel, the right-side panel, and the back panel;

a first folding shelf in pivotable connection with the left-side panel and the front panel proximal to a bottom of the first opening in the front panel, the first folding shelf having a pivotable fold along a diagonal axis bisecting the first folding shelf, wherein the first folding shelf transitions between a collapsed flattened configuration between the left-side panel and front panel and a deployed configuration, where the first folding shelf is positioned perpendicular the left-side panel and front panel proximal the bottom of the first opening; and a second folding shelf in pivotable connection with the left-side panel and the front panel proximal to a bottom of the second opening in the front panel, the second folding shelf having a pivotable fold along a diagonal axis bisecting the second folding shelf, wherein the second folding shelf transitions between a collapsed flattened configuration between the left-side panel and front panel and a deployed configuration, where the second folding shelf is positioned perpendicular the left-side panel and front panel proximal to the bottom of the second opening;

wherein when the foldable frame, first folding shelf, and second folding shelf are in the deployed configurations, the deployed standing display configuration of the foldable frame maintains and locks the deployed configuration of the first and second folding shelves into place, while the deployed configuration of the first and second shelves maintains and locks the foldable frame in the deployed standing display configuration; and pressing on the side panels of the foldable frame to transition the folding shelf display from the collapsed flattened configuration to the deployed standing display configuration wherein the first and second shelves are also transitioned from the flattened configuration to the deployed configuration.

20. The method of claim 19, wherein the frame comprises a sheet of foldable material having at least three fold lines along a length dimension of the sheet defining the left-side panel, front panel, right-side panel, and back panel and wherein a fold in the fold lines provides the pivotable connection between the panels.

21. The method of claim 20, wherein the foldable material comprises cardboard.

22. The method of claim 20, wherein the pivotable connection between the back panel and the left-side panel comprises a fold at a fold line defining a tab on the sheet located on an edge of the left-side panel opposite the fold line and fold that comprises the pivotable connection to the front panel that is secured to an edge of the back panel opposite the fold line and fold that comprises the pivotable connection to the right-side panel.

23. The method of claim 19, wherein the first and second folding shelves comprise a sheet of foldable material having a fold line comprising the pivotable fold diagonally bisecting the shelf and wherein the pivotable connections to the left-side panel and front panel comprise folds at fold lines defining tabs on sides of the folding shelf that are secured to the left-side panel and front panel.

24. The method of claim 23, wherein the first and second folding shelves further comprise a top panel of foldable material attached to a diagonally bisected portion of the folding shelf, the top panel further comprising:

two or more tabs along a back edge of the folding shelf for securing the shelf when in the deployed configuration; and an angled fold line along a depth dimension of the shelf configured to allow a portion of the top panel having at least one of the two or more tabs to be folded over the shelf when in the collapsed flattened configuration.

25. The method of claim 19, further comprising:

a first folding shelf support pivotably connected to the right-side panel and the back panel in proximity to a bottom of the first opening in the front panel, the folding shelf support having a pivotable fold along a diagonal axis bisecting the shelf support, wherein the first folding shelf support transitions between a collapsed flattened configuration between the right-side panel and back panel and a deployed configuration, where the first folding shelf support is positioned perpendicular the right-side panel and the back panel below the first folding shelf proximal to the bottom of the first opening; and a second folding shelf support pivotably connected to the right-side panel and the back panel in proximity to a bottom of the second opening in the front panel, the second folding shelf support having a pivotable fold along a diagonal axis bisecting the shelf support, wherein the second folding shelf support transitions between a collapsed flattened configuration between the right-side panel and back panel and a deployed configuration, where the second folding shelf support is positioned perpendicular the right-side panel and back panel below the second folding shelf proximal to the bottom of the second opening.

26. The method of claim 25, wherein the first folding shelf support and the second folding shelf support comprise a sheet of foldable material having a fold line comprising the pivotable fold diagonally bisecting the shelf support and wherein the pivotable connections to the right-side panel and back panel comprise folds at fold lines defining tabs on sides of the folding shelf support that are secured to the right-side panel and back panel.

27. The method of claim 19, wherein the left-side panel and right-side panel further comprise a top reinforcement tab defined by a fold line along a width dimension of the panel, wherein the top reinforcement tab is folded over and secured to the panel along the fold line.

28. The method of claim 19, wherein the front panel further comprises:

a first set of outward folding tabs defined by fold lines along a length dimension on sides of the first opening, wherein the outward folding tabs are folded out from the first opening and secured to the left-side panel and right-side panel of the foldable frame;

a first securing tab defined by a fold line along a width dimension at a bottom of the first opening; wherein the first securing tab is folded over into the deployed standing display configuration of the foldable frame to secure the first folding shelf in a deployed configuration;

a first reinforcement tab defined by a fold line along a width dimension at a top of the second opening; wherein the first reinforcement tab is folded over and secured to the front panel providing a reinforced area where the first folding shelf is pivotably connected to the front panel;

a second set of outward folding tabs defined by fold lines along a length dimension on sides of the second opening, wherein the outward folding tabs are folded out from the second opening and secured to the left-side panel and right-side panel of the foldable frame;

a second securing tab defined by a fold line along a width dimension at a bottom of the second opening; wherein the second securing tab is folded over into the deployed standing display configuration of the foldable frame to secure the second folding shelf in a deployed configuration; and a bottom reinforcement tab defined by a fold line along a width dimension at a bottom of the front panel; wherein the reinforcement tab is folded over and secured to the front panel providing a reinforced area where the second folding shelf is pivotably connected to the front panel.

29. The method of claim 19, wherein the back panel comprises a top reinforcement tab defined by a fold line with cut-outs along a width dimension of the panel, wherein the top reinforcement tab is folded over into the deployed standing display configuration of the frame.

30. The method of claim 29, further comprising a header panel attached to the foldable frame in the deployed standing display configuration using the cut-outs in the top reinforcement tab.

31. The method of claim 19, further comprising:

the front panel of the folding frame further comprising a third opening disposed in the front panel; and a third folding shelf pivotably connected to the left-side panel and the front panel proximal to a bottom of the third opening in the front panel, the third folding shelf having a pivotable fold along a diagonal axis bisecting the shelf, wherein the third folding shelf transitions between a collapsed flattened configuration between the left-side panel and the front panel and a deployed configuration where the third folding shelf is positioned perpendicular the left-side panel and the front panel proximal to the bottom of the third opening.

32. The method of claim 31, wherein the third folding shelf comprises a sheet of foldable material having a fold line comprising the pivotable fold diagonally bisecting the shelf and wherein the pivotable connections to the left-side panel and the front panel comprise folds at fold lines defining tabs on sides of the folding shelf that are secured to the left-side panel and front panel.

33. The method of claim 32, wherein the third folding shelf further comprises a top panel of foldable material attached to a diagonally bisected portion of the folding shelf, the top panel further comprising:

two or more tabs along a back edge of the folding shelf for securing the shelf when in the deployed configuration; and an angled fold line along a depth dimension of the shelf configured to allow a portion of the top panel having at least one of the two or more tabs to be folded over the shelf when in the collapsed flattened configuration.

34. The method of claim 31, further comprising:

a third folding shelf support pivotably connected to the right-side panel and the back panel in proximity to a bottom of the third opening in the front panel, the third folding shelf support having a pivotable fold along a diagonal axis bisecting the shelf support, wherein the third folding shelf support transitions between a collapsed flattened configuration between the right-side panel and the back panel and a deployed configuration where the third folding shelf support is positioned perpendicular the right-side panel and the back panel below the third folding shelf proximal to the bottom of the third opening.

35. The method of claim 34, wherein the third folding shelf support comprises a sheet of foldable material having a fold line comprising the pivotable fold diagonally bisecting the shelf support and wherein the pivotable connections to the right-side panel and the back panel comprise folds at fold lines defining tabs on sides of the folding shelf support that are secured to the right-side panel and the back panel.

36. The method of claim 31, wherein the front panel further comprises:

a first set of outward folding tabs defined by fold lines along a length dimension on sides of the first opening, wherein the outward folding tabs are folded out from the first opening and secured to the left-side panel and the right-side panel of the foldable frame;

a first securing tab defined by a fold line along a width dimension at a bottom of the first opening; wherein the first securing tab is folded over into the deployed standing display configuration of the foldable frame to secure the first folding shelf in the deployed configuration;

a first reinforcement tab defined by a fold line along a width dimension at a top of the second opening; wherein the reinforcement tab is folded over and secured to the front panel providing a reinforced area where the first folding shelf is pivotably connected to the front panel;

a second set of outward folding tabs defined by fold lines along a length dimension on sides of the second opening, wherein the outward folding tabs are folded out from the second opening and secured to the left-side panel and right-side panel of the foldable frame;

a second securing tab defined by a fold line along a width dimension at a bottom of the second opening; wherein the second securing tab is folded over into the deployed standing display configuration of the foldable frame to secure the second folding shelf in the deployed configuration;

a second reinforcement tab defined by a fold line along a width dimension at a top of the third opening; wherein the second reinforcement tab is folded over and secured to the front panel providing a reinforced area where the second folding shelf is pivotably connected to the front panel;

a third set of outward folding tabs defined by fold lines along a length dimension on sides of the third opening, wherein the outward folding tabs are folded out from the third opening and secured to the left-side panel and right-side panel of the foldable frame;

a third securing tab defined by a fold line along a width dimension at a bottom of the third opening; wherein the third securing tab is folded over into the deployed standing display configuration of the foldable frame to secure the third folding shelf in the deployed configuration; and a bottom reinforcement tab defined by a fold line along a width dimension at a bottom of the front side panel; wherein the reinforcement tab is folded over and secured to the front panel providing a reinforced area where the third folding shelf is pivotably connected to the front panel.

* * * * *